US008267547B2

(12) United States Patent
Cunningham

(10) Patent No.: US 8,267,547 B2
(45) Date of Patent: Sep. 18, 2012

(54) INCANDESCENT ILLUMINATION SYSTEM INCORPORATING AN INFRARED-REFLECTIVE SHROUD

(76) Inventor: David W. Cunningham, Los Angeles, CA (US)

( * ) Notice: Subject to any disclaimer, the term of this patent is extended or adjusted under 35 U.S.C. 154(b) by 299 days.

(21) Appl. No.: 12/823,083

(22) Filed: Jun. 24, 2010

(65) Prior Publication Data

US 2010/0328955 A1 Dec. 30, 2010

Related U.S. Application Data

(60) Provisional application No. 61/220,152, filed on Jun. 24, 2009, provisional application No. 61/273,416, filed on Aug. 3, 2009, provisional application No. 61/235,653, filed on Aug. 20, 2009, provisional application No. 61/239,389, filed on Sep. 2, 2009, provisional application No. 61/307,771, filed on Feb. 24, 2010.

(51) Int. Cl.
*F21V 14/00* (2006.01)

(52) U.S. Cl. ... 362/255; 362/211; 362/214; 362/217.07; 362/296.01; 362/341

(58) Field of Classification Search ..... 362/211, 362/214, 217.02, 217.05, 217.07, 253, 257, 362/293, 296.01, 341, 351, 255
See application file for complete search history.

(56) References Cited

U.S. PATENT DOCUMENTS

| | | | |
|---|---|---|---|
| 3,801,178 | A | 4/1974 | Van Den Berge |
| 4,017,758 | A | 4/1977 | Almer et al. |
| 4,127,789 | A | 11/1978 | Kostlin et al. |
| 4,346,324 | A | 8/1982 | Yoldas |
| 4,467,238 | A | 8/1984 | Silverstein et al. |
| 4,507,547 | A | 3/1985 | Taga et al. |
| 4,754,377 | A | 6/1988 | Wenman |
| 5,337,191 | A | 8/1994 | Austin |
| 5,473,226 | A | 12/1995 | Beschle et al. |
| 5,705,882 | A | 1/1998 | Oughton |
| 5,756,192 | A | 5/1998 | Crawley et al. |
| 5,831,375 | A | 11/1998 | Benson, Jr. |

(Continued)

FOREIGN PATENT DOCUMENTS

| | | |
|---|---|---|
| GB | 444560 | 12/1934 |

(Continued)

*Primary Examiner* — Meghan Dunwiddie
(74) *Attorney, Agent, or Firm* — Sheppard, Mullin, Richter & Hampton LLP

(57) ABSTRACT

An improved incandescent lamp and incandescent lighting system are disclosed, for projecting a beam of light with substantially improved energy efficiency. The incandescent lamp includes a pair of reflective ceramic filament supports for supporting one or more filaments in prescribed position(s) within an envelope while reflecting back substantially all visible and infrared light for incorporation into the projected beam or for absorption by the filament(s). The incandescent lighting system includes a special infrared-reflective shroud concentrically encircling the incandescent lamp, for reflecting infrared light back toward the lamp filament(s) while transmitting visible light to a concave reflector for incorporation into the projected beam. The infrared-reflective coating is deposited onto the shroud's inner surface, and it includes a dielectric coating and an underlying transparent conductive coating. The lamp and the shroud are separately mounted relative to the concave reflector and are configured such that the lamp is removable without requiring removal of the shroud.

52 Claims, 21 Drawing Sheets

U.S. PATENT DOCUMENTS

| | | | |
|---|---|---|---|
| 5,977,694 | A | 11/1999 | McGuire |
| 5,982,078 | A | 11/1999 | Krisl et al. |
| 6,087,775 | A | 7/2000 | Levinson et al. |
| 6,212,004 | B1 | 4/2001 | Stachowiak et al. |
| 6,436,541 | B1 | 8/2002 | Sopko et al. |
| 6,476,556 | B2 | 11/2002 | Cottaar |
| 6,534,903 | B1 | 3/2003 | Spiro et al. |
| 2003/0077459 | A1 | 4/2003 | Vitt et al. |
| 2003/0198808 | A1 | 10/2003 | Muromachi et al. |
| 2007/0138926 | A1 | 6/2007 | Brown et al. |

FOREIGN PATENT DOCUMENTS

| | | |
|---|---|---|
| GB | 444560 | 3/1936 |
| JP | 2001176452 | 6/2001 |
| WO | WO 8602775 | 5/1986 |
| WO | WO 2004056564 | 7/2004 |
| WO | 2006110379 | 10/2006 |

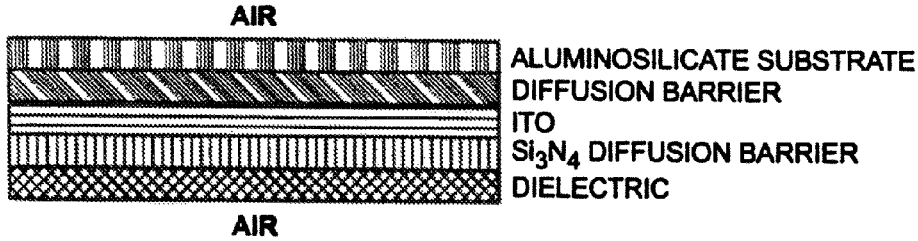

FIG. 10A

| # | MATERIAL | THICKNESS, NM |
|---|---|---|
| | ALUMINO-SILICATE | |
| 1 | $Si_3N_4$ * | 50.0 |
| 2 | SWITO | 350.0 |
| 3 | $Si_3N_4$ * | 50.0 |
| 4 | $Nb_2O_5$ | 87.5 |
| 5 | $SiO_2$ | 10.4 |
| 6 | $Nb_2O_5$ | 23.7 |
| 7 | $SiO_2$ | 181.7 |
| 8 | $Nb_2O_5$ | 112.1 |
| 9 | $SiO_2$ | 196.3 |
| 10 | $Nb_2O_5$ | 22.1 |
| 11 | $SiO_2$ | 25.9 |
| 12 | $Nb_2O_5$ | 128.0 |
| 13 | $SiO_2$ | 181.9 |
| 14 | $Nb_2O_5$ | 117.7 |
| 15 | $SiO_2$ | 221.0 |
| 16 | $Nb_2O_5$ | 15.1 |
| 17 | $SiO_2$ | 36.5 |
| 18 | $Nb_2O_5$ | 107.9 |
| 19 | $SiO_2$ | 21.8 |
| 20 | $Nb_2O_5$ | 14.6 |
| 21 | $SiO_2$ | 369.1 |
| 22 | $Nb_2O_5$ | 126.4 |
| 23 | $SiO_2$ | 37.6 |

TCC LAYERS

DIELECTRIC LAYERS

* DIFFUSION BARRIERS

| # | MATERIAL | THICKNESS, NM |
|---|---|---|
| 24 | $Nb_2O_5$ | 19.4 |
| 25 | $SiO_2$ | 220.1 |
| 26 | $Nb_2O_5$ | 106.7 |
| 27 | $SiO_2$ | 400.9 |
| 28 | $Nb_2O_5$ | 120.2 |
| 29 | $SiO_2$ | 34.6 |
| 30 | $Nb_2O_5$ | 24.5 |
| 31 | $SiO_2$ | 213.2 |
| 32 | $Nb_2O_5$ | 108.1 |
| 33 | $SiO_2$ | 161.1 |
| 34 | $Nb_2O_5$ | 81.9 |
| 35 | $SiO_2$ | 147.7 |
| 36 | $Nb_2O_5$ | 92.4 |
| 37 | $SiO_2$ | 162.9 |
| 38 | $Nb_2O_5$ | 99.5 |
| 39 | $SiO_2$ | 155.4 |
| 40 | $Nb_2O_5$ | 30.9 |
| 41 | $SiO_2$ | 13.1 |
| 42 | $Nb_2O_5$ | 32.1 |
| 43 | $SiO_2$ | 157.5 |
| 44 | $Nb_2O_5$ | 90.3 |
| 45 | $SiO_2$ | 61.5 |
| | AIR | |
| | TOTAL | 5021 |

DIELECTRIC LAYERS

FIG. 10B

INCANDESCENT ILLUMINATION SYSTEM INCORPORATING AN INFRARED-REFLECTIVE SHROUD

CROSS-REFERENCE TO RELATED APPLICATIONS

Priority is claimed under 35 U.S.C. §119(e) to U.S. Provisional Application No. 61/220,152, filed by David W. Cunningham on Jun. 24, 2009, and entitled "Incandescent Illumination System Having an Infrared-Reflective Shroud and Reflective Filament Supports"; U.S. Provisional Application No. 61/273,416, filed by David W. Cunningham on Aug. 3, 2009, and entitled "Incandescent Illumination System Having an Infrared-Reflective Shroud and Reflective Filament Supports"; U.S. Provisional Application No. 61/235,653, filed by David W. Cunningham on Aug. 20, 2009, and entitled "Incandescent Illumination System Having an Infrared-Reflective Shroud and Reflective Filament Supports"; U.S. Provisional Application No. 61/239,389, filed by David W. Cunningham on Sep. 2, 2009, and entitled "Incandescent Illumination System Having an Infrared-Reflective Shroud and Reflective Filament Supports"; and U.S. Provisional Application No. 61/307,771, filed by David W. Cunningham on Feb. 24, 2010, and entitled "Incandescent Illumination System Having an Infrared-Reflective Shroud and Reflective Filament Supports." These applications all are incorporated herein by reference.

BACKGROUND OF THE INVENTION

This invention relates generally to incandescent lamps and, more particularly, to incandescent lamps configured to provide improved energy efficiency and to methods for making such lamps. This invention also relates generally to incandescent illumination systems for projecting a beam of light and, more particularly, to incandescent illumination systems of a kind that reflect IR light back to an incandescent lamp's filament, to increase the system's energy efficiency.

Prior incandescent lamps typically have included one or more filaments supported at their ends by a bridge assembly containing components formed of tungsten and quartz. Although most of the light emitted by the filament(s) is emitted outwardly from the lamp, a portion of it is emitted in directions toward the lamp's base end or toward the tungsten/quartz bridge assembly, where it is generally wasted, either by absorption or by scattering in undesired directions.

In addition, prior incandescent illumination systems of this kind typically have included a lighting fixture that mounts an incandescent lamp with its filament(s) located at or near the focal point of a concave reflector. Light emitted by the lamp is reflected by the reflector, to project a beam of light. In some cases, the incandescent lamp has included an IR-reflective coating in the form of a multi-layer stack of dielectric material coated directly onto the lamp's envelope. The coating functions to transmit visible light but reflect infrared light back to the lamp filament, where a portion of that reflected light is absorbed. This absorption heats the filament and thus reduces the amount of electrical energy required to heat the filament to its operating temperature. This improves the lamp's energy efficiency. The system typically is embodied in a wash-light fixture, for projecting a non-imaged beam of light, but alternatively could be embodied in an imaging lighting fixture, for projecting an image at a distant location.

Incandescent illumination systems of this kind are not believed to have been as energy-efficient or cost-effective as possible. One drawback has arisen because the IR-reflective coating typically has been located on the lamp envelope itself, which requires that the coating be replaced whenever the lamp burns out or otherwise fails. The coating can represent a significant portion of the lamp's manufacturing cost, so this requirement has raised the system's overall operating cost. Another drawback is that the IR-reflective coatings have not reflected as much IR light as is possible, while remaining cost-effective. One example of such an incandescent lamp is disclosed in U.S. Pat. No. 4,017,758 to Almer et al.

Yet another drawback to the incandescent illumination systems of this kind is that the systems have failed to collect a significant amount of light emitted by the lamp filament(s) in directions other than directly toward the concave reflector, i.e., light emitted in a forward direction beyond the reflector's forward extent or in a rearward direction toward the lamp's base. This light fails to strike the concave reflector and is either absorbed by the system or projected as stray light outside the projected beam's desired field angle. The absorption by the system causes excessive heating, which generally has required the system to comprise a housing made of metal, thus adding undesired weight and cost. In addition, the stray light is highly undesirable when the system is intended to illuminate only specific areas or objects.

One attempt to design an incandescent lamp that better utilizes light emitted by the lamp filament in undesired directions, e.g., in a direction toward the lamp's base, is disclosed in the Almer et al. patent, identified above. The disclosed lamp includes concentric, cylindrical inner and outer envelopes, with a filament extending longitudinally within the inner envelope. Two reflective, disc-shaped filament supports are located at the opposite ends of the inner envelope and two reflective rings are located at the opposite ends of the space between the two concentric envelopes, in alignment with the disc-shaped filament supports. An IR-reflective coating, incorporating both an interference filter and a metal oxide filter, is located on the inner surface of the outer envelope. This coating is configured to reflect infrared light back toward the filament and transmit visible light outwardly.

One lamp disclosed in the Almer et al. patent is said to provide a very high efficiency of 44.9 lumens per watt, nearly double the efficiency of a similar lamp lacking an IR-reflective coating. It is apparent, however, that any such high efficiency would have been short-lived, making the lamp of limited commercial value. This is because the metal oxide filter likely would have been rapidly degraded by the infusion of oxygen from the adjacent interference filter or outer envelope. The patent lacks any suggestion of a solution to this degradation problem; in fact, it lacks even a recognition of the problem itself. The patent also lacks any disclosure of suitable materials for its reflective disc-shaped filament supports and its reflective rings. These deficiencies might explain the lack of any apparent commercialization of the lamp, despite its stated improvement in efficiency.

It should, therefore, be appreciated that there remains a need for an improved incandescent lamp, and for an improved incandescent illumination system, that are configured to more completely collect and utilize light emitted by the lamp filament(s). It should also be appreciated that there remains a need for an improved incandescent illumination system configured to avoid the need to replace an IR-reflective coating when the system's incandescent lamp is replaced. The present invention satisfies these and other needs.

SUMMARY OF THE INVENTION

The present invention resides in an incandescent lamp and incandescent illumination system for projecting a beam of light configured to project a beam of light with substantially improved energy efficiency. The lamp includes one or more filaments for emitting visible light and infrared light, and it is removably received and retained in a lighting fixture that includes a concave reflector, a socket for supporting the incandescent lamp in a prescribed position relative to the reflector, and a shroud surrounding at least a portion of the incandescent lamp when it is in its prescribed position. The shroud includes a substrate and an infrared-reflective coating, preferably on the inner surface of the substrate facing the lamp, that is configured to reflect a substantial portion of infrared light back to the lamp filament(s), and to transmit a substantial portion of visible light to the reflector, which in turn reflects such visible light to project a beam of light along a longitudinal fixture axis. In addition, the lamp and the shroud are separately mounted in prescribed positions relative to the concave reflector and are configured such that the incandescent lamp is removable from the lighting fixture without requiring removal of the shroud.

In a more detailed feature of the invention, the incandescent lamp further includes an envelope having a substantially cylindrical portion surrounding the one or more filaments, and the shroud likewise has a substantially cylindrical shape, and the envelope and shroud are mounted substantially concentric with the longitudinal fixture axis. The longitudinal axes of the lamp and the fixture are substantially aligned with each other, preferably being spaced apart from each other by no more than about 4-10% of the diameter of the envelope's substantially cylindrical portion, or alternatively by no more than about 0.50 mm. The lamp envelope can be formed of fused silica glass, and the shroud substrate can be formed of alumino-silicate glass. In addition, the lamp filament(s) preferably are linear and oriented in alignment with, or parallel with, the lamp's longitudinal axis. If the lamp includes more than one filament, the filaments are mounted around the lamp's longitudinal axis.

In a separate and independent feature of the invention, the shroud's IR-reflective coating system includes a dielectric coating deposited onto the inner surface of the transparent substrate. The dielectric coating preferably is deposited using a plasma-impulse chemical vapor deposition or atomic layer deposition process. The coating system also can further include a transparent conductive coating (TCC) underlying the dielectric coating. The shroud's transparent substrate transmits a substantial portion of visible light transmitted through the dielectric coating and the optional TCC.

In a more detailed feature of the invention, suitable for use in embodiments in which the coating system includes both a dielectric coating and a TCC, the coating system further includes diffusion barrier layers located between the dielectric coating and the TCC and between the TCC and the transparent substrate. These diffusion barriers can include a material selected from the group consisting of silicon nitride, aluminum oxide, and silicon dioxide. The TCC can be formed of a material selected from the group consisting of indium-doped tin oxide, aluminum-doped zinc oxide, titanium-doped indium oxide, fluorine-doped tin oxide, fluorine-doped zinc oxide, cadmium stannate, gold, silver, and mixtures thereof.

In a separate and independent feature of the invention, the dielectric coating includes a plurality of dielectric layers having prescribed refractive indices and prescribed thicknesses, alternating between layers of a first material having a relatively low refractive index and layers of a second material having a relatively high refractive index. In addition, the shroud's transparent substrate and the dielectric coating's second material preferably have coefficients of thermal expansion that differ from each other by no more than a factor of 2.5. The second material preferably is selected from the group consisting of niobia, titania, tantala, and mixtures thereof, and the transparent substrate preferably is alumino-silicate glass.

In yet another separate and independent feature of the invention, the incandescent lamp includes, in addition to an envelope and one or more filaments, forward and rearward filament supports positioned in the interior space of the envelope, with the one or more filaments disposed between them, wherein each filament support comprises a block of material extending transversely across substantially the entire interior space of the envelope and having an average total reflectance of at least 90%, or more preferably at least 95%, across a wavelength range of 500 to 2000 nanometers. The portion of the lamp envelope surrounding the one or more filaments and the forward and rearward filament supports has a substantially cylindrical shape, and the forward and rearward filament supports each have a substantially cylindrical side wall sized to fit snugly within the envelope.

In other, more detailed features of the invention, the forward and rearward filament supports each include a face that faces the one or more filaments and reflects light received from the one or more filaments back toward the one or more filaments, the face of the other filament support, or the portion of the envelope located radially outward of the one or more filaments. These faces both provide diffuse reflection of light received from the one or more filaments. In optional features of the invention, portions of filament supports, other than their faces, can have a grooved configuration or can carry an emissive coating having a high emissivity in a wavelength in the range of about 2-4 microns, to increase heat dissipation.

In yet other more detailed features of the invention, the forward and rearward filament supports both are formed primarily of a porous ceramic material, e.g., a material selected from the group consisting of alumina, zirconia, magnesia, and mixtures thereof. The filament supports both are substantially alkali- and hydroxyl-free and have a calcia concentration of less than or equal to 80 parts per million (ppm), or more preferably less than or equal to 20 ppm, or most preferably less than or equal to 10 ppm.

In another feature of the invention, the filament supports both have a grain size distribution ranging from about 1 to 50 microns, and an average grain size in the range of about 5 to 15 microns. The filament supports also both preferably have a density in the range of about 92-98%, or more preferably in the range of about 93-97%, of their theoretical maximum density. They also both have a closed porosity or an open porosity of less than about 1%, or more preferably less than about 0.5%.

In other features of the invention, the lamp is free of any support structure located in the interior space of the envelope, radially outward of the one or more filaments. Alternatively, the lamp can include one or more elongated supports extending between the forward and rearward filament supports and oriented substantially parallel with the longitudinal axis of the envelope, wherein the elongated supports are substantially transparent in the wavelength range of about 500 to 2500 nanometers.

In still other more detailed features of the invention, the envelope includes forward and rearward pinched ends, with the forward filament support located adjacent to the forward pinched end and the rearward filament support located adjacent to the rearward pinched end. The filament supports can substantially fill the interior space of the envelope between each of them and their adjacent pinched ends. Alternatively the lamp can further include a halogen-compatible filler material substantially filling the space within the envelope between the filament supports their adjacent pinched ends.

In one embodiment of the invention, the lamp includes only a single linear filament, and the forward filament support and the rearward filament support each include a lead aperture for slidably receiving one of two power leads. The locations of the lead apertures in the two filament supports position the filament in a prescribed position in the interior space of the envelope, with its linear axis substantially aligned with the longitudinal axis of the envelope.

In another embodiment of the invention, the lamp includes only two substantially identical linear filaments connected together in series by an intervening loop. In this embodiment, the rearward filament support includes two lead apertures, each sized to slidably receive a separate one of two power leads, and the forward filament support includes a support hook aperture configured to support a support hook that supports the loop connecting the two filaments. The locations of the lead apertures and the support hook aperture positioning the two filaments in prescribed positions in the interior space of the envelope, with their linear axes substantially parallel to, and on opposite sides of the longitudinal axis of the envelope.

In yet another embodiment of the invention, the lamp includes an odd number of three or more substantially identical linear filaments connected together in series by intervening loops. In this embodiment, the forward and rearward filament supports each include a lead aperture, each sized to slidably receive a separate one of two power leads, and the two filament supports together include a plurality of support hook apertures, each configured to support a separate one of a plurality of support hooks that each support one of the loops connecting adjacent filaments of the three or more filaments. The locations of the lead apertures and the support hook apertures position the three or more filaments in prescribed positions in the interior space of the envelope, with their linear axes substantially parallel to, and spaced around, the longitudinal axis of the envelope.

In still another embodiment of the invention, the lamp includes an even number of four or more substantially identical linear filaments connected together in series by intervening loops. In this embodiment, the rearward filament support includes two lead apertures, each sized and configured to slidably receive a separate one of two power leads, and the two filament supports together further include a plurality of support hook apertures, each configured to support a separate one of a plurality of support hooks that each support one of the loops connecting adjacent filaments of the four or more filaments. The locations of the lead apertures and the support hook apertures position the four or more filaments in prescribed positions in the interior space of the envelope, with their linear axes substantially parallel to, and spaced around, the longitudinal axis of the envelope.

In all of these embodiments, the support hooks each can be sized and configured to be retained within a support hook aperture by a snap fit. In addition, each of the power lead apertures can include an enlarged portion having a transverse dimension substantially larger than that of the power lead extending through it.

In a separate and independent feature of the invention, these lamp embodiments can each further include segments of tungsten wire wrapped around the two power leads, adjacent to the ends of the power lead apertures, for securing the associated forward or rearward filament support in its prescribed position in the interior space of the envelope. In addition, each of the power leads can be a separate tungsten rod, and the power lead apertures can include an enlarged portion having a transverse dimension substantially larger than that of the power lead extending through it. The end of the filament adjacent to each such power lead can be wrapped around the power lead in the enlarged end portion of the associated power lead aperture.

In another feature of the invention, the forward and rearward filament supports can each further include a channel for allowing gas to migrate between the space surrounding the one or more filaments and the space within the envelope on the side of the filament support opposite the one or more filaments. Each such channel can be located in a radially outward-facing surface of the filament support.

Another separate and independent feature of the invention resides in a method for making the incandescent lamp. Specifically, the method includes steps of providing an unsealed, elongated envelope having an interior space, providing one or more filaments, providing two leads, and providing forward and rearward filament supports, the filament supports together including two apertures, each for slidably receiving and supporting a separate one of the two leads. The method further includes steps of mounting the one or more filaments to the forward and rearward filament supports, with the one or more filaments disposed between them, and then slidably positioning the forward and rearward filament supports, with the one or more filaments mounted thereto, in the interior space of the envelope. Finally, the method includes a step of sealing the envelope.

In more detailed features of the method of the invention, wherein the forward and rearward filament supports both comprise a block of reflective ceramic material sized and configured to extend transversely across substantially the entire interior space of the envelope. The forward and rearward filament supports both can be formed using a step of molding them as a single, unitary structure and also using a step of sintering them prior to their being slidably positioned within the lamp envelope.

In another more detailed feature of the method of the invention, the two filament supports each can define a channel for allowing a gas to migrate past it after the filament supports have been slidably positioned in the interior space of the envelope. These channels can be defined in outward-facing surfaces of the two filament supports. In addition, the step of sealing the envelope includes the steps of pumping a non-reacting gas through the interior space of the envelope and the channel of the forward filament support while pinching closed the forward end of the envelope, and pumping a non-reacting gas through the interior space of the envelope and the channel of the rearward filament support while pinching closed the rearward end of the envelope.

The method can further include a step of providing an exhaust port in the envelope, for use in the steps of pumping the non-reacting gas. In addition, the step of slidably positioning can include a step of aligning the channel with the exhaust port, to facilitate the pumping steps. Further, the final step of pumping can be accompanied by a step of applying a tensile force to the lamp's leads and, in turn, to the plurality of filaments.

Other features and advantages of the invention should become apparent from the following description of the preferred embodiments, taken in conjunction with the accompanying drawings, which illustrate, by way of example, the principles of the invention.

BRIEF DESCRIPTION OF THE DRAWINGS

FIG. 10A is a schematic cross-sectional view (not to scale) of a first embodiment of a coating system in accordance with the invention, including a dielectric coating and a transparent conductive coating in the form of indium-doped tin oxide, both coatings deposited onto the inner surface of a shroud substrate formed of alumino-silicate glass.

FIG. 10B is a table setting forth the specific materials and thicknesses for the individual layers of the coating system of FIG. 10A.

DETAILED DESCRIPTION OF THE PREFERRED EMBODIMENTS

Figure 1A:
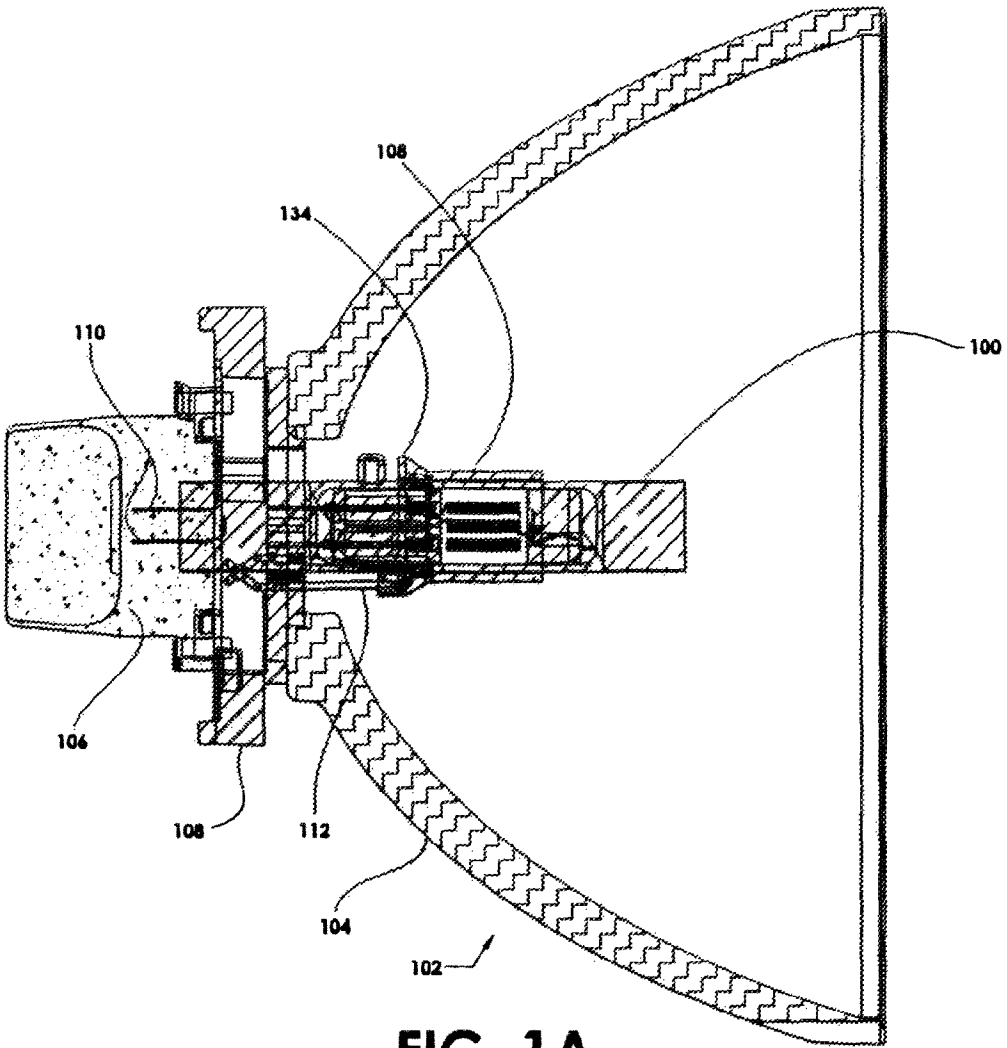
FIG. 1A is a side section view of an incandescent illumination system in accordance with one preferred embodiment of the invention, the system incorporating an incandescent lamp and a lighting fixture having a concave reflector that mounts the lamp and a cylindrical shroud encircling the lamp and carrying an IR-reflective coating for reflecting IR light back toward the lamp's filaments.

With reference now to the illustrative drawings, and particularly to FIG. 1A, there is shown an incandescent illumination system in accordance with a preferred embodiment of the invention, for projecting a beam of light. The system includes an incandescent lamp 100 mounted in a lighting fixture 102 of a kind that includes a concave reflector 104, a socket 106 for supporting the lamp in a precise position relative to the concave reflector, and a transparent shroud 108 encircling the lamp. The shroud includes a special coating system that transmits visible light emitted by the lamp's filament(s), but reflects infrared (IR) light back to the filament(s), where a portion of it is absorbed, to heat the filament. This reduces the amount of electrical energy required to heat the filament(s) to its operating temperature, thus improving the lamp's energy efficiency.

The lighting fixture 102 depicted in FIG. 1A is configured for use with a single-ended lamp 100. Thus, the fixture's socket 106 is configured to connect to a pair of power connectors 110 projecting from the lamp's rearward end. In an alternative embodiment, not shown in the drawings, the lighting fixture can be configured for use with a double-ended lamp, which includes a separate power connector projecting from each of its forward and rearward ends. In that latter embodiment, the lighting fixture differs from the one depicted in FIG. 1A in that it further includes a forward socket for connecting to the lamp's forward power connector. This forward socket can be secured in place by attachment to the shroud or by a separate metallic support. Electrical power can be delivered to the forward socket by a blade-shaped conductor, to minimize interference with the projected light beam.

A double-ended incandescent lamp 112 in accordance with the invention is depicted in FIGS. 2A-2D. The lamp includes a generally cylindrical quartz glass envelope 114 and a filament 116 in the form of a single linear coil of tungsten wire.

The filament is mounted concentrically within the envelope by forward and rearward filament supports 118*a*, 118*b*, respectively, which are formed of a reflective ceramic material and which have a cylindrical shape sized to slide into the envelope. The filament 116 is positioned in its prescribed concentric position by slidably positioning the opposite ends of the tungsten filament wire, which form leads 120*a*, 120*b*, through lead apertures 122*a*, 122*b* centrally located in the respective forward and rearward filament supports. Segments of tungsten wire are helically wrapped around the portions of the leads 120*a*, 120*b* located within the lead apertures, to form first overwraps 124*a*, 124*b*, respectively, that increase electrical conductivity and thereby reduce heating of the leads.

The ends of the two filament leads 120*a*, 120*b* connect via thin molybdenum foils 126*a*, 126*b* to power connectors 128*a*, 128*b* located at the lamp's respective forward and rearward ends. The filament supports 118*a*, 118*b* are each sized to fit snugly within the envelope 114, with adequate allowances for manufacturing tolerances and for differentials in thermal expansion of the filament supports and the envelope. Each filament support is slidably positioned as close as possible to an end of the filament 116, and it preferably is secured in that position by second overwraps of tungsten wire 130*a*, 130*b* helically wrapped around the lead and the first overwraps 124*a* or 124*b*, at opposite ends of the lead aperture 122*a* or 122*b*. The outer ends of the wires that form these second overwraps project radially outward to form fingers 132 that engage and secure the adjacent filament support in place. Alternatively, the end-most turns of the filament 116, itself, can function to position the inwardly facing ends of the two filament supports.

Structure for mounting the transparent shroud 108 in a position concentric with the incandescent lamp 100 is depicted in FIG. 1B-1G. The shroud has a cylindrical shape, and it seats in a special ceramic ring 134 that is mounted by two wire spring clips 136 to a base plate 138 secured to the base end of the concave reflector 104. The ring (FIGS. 1C-1E) includes a flat face 140 and four forwardly projecting uprights 142 spaced uniformly around the face. The rearward end of the shroud 108 seats on this ring face, and it is secured in that position by a high-temperature potting compound (not shown) deposited into V-shaped recesses formed in the inwardly facing sides of the uprights.

Figure 1B:
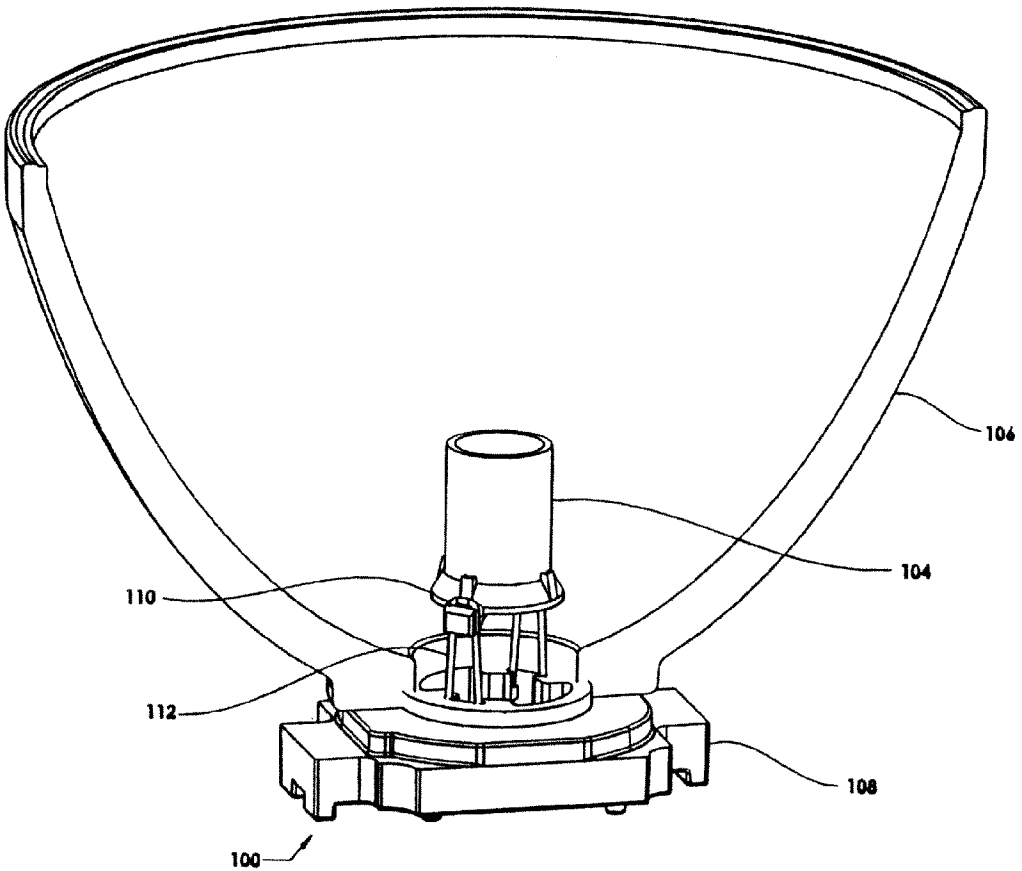
FIG. 1B is a cutaway sectional view of the lighting fixture portion of the incandescent illumination system of FIG. 1A, showing structure for mounting the cylindrical IR-reflective shroud.
Figure 1D:
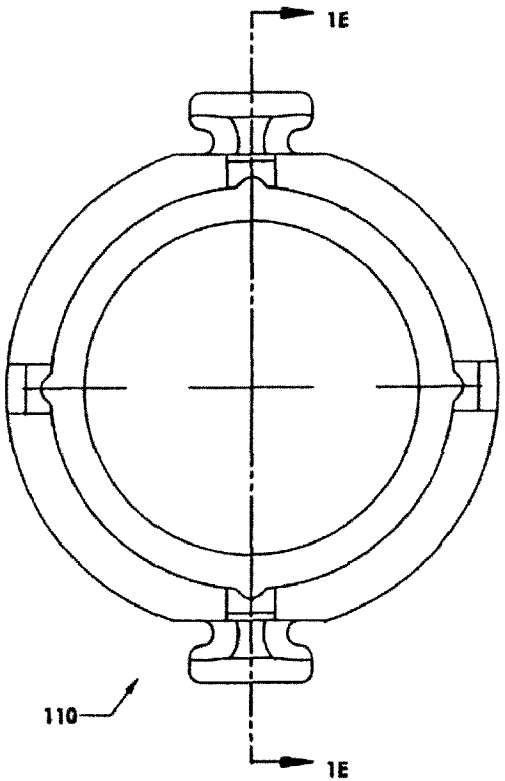
FIGS. 1C, 1D and 1E are isometric, side sectional, and front views of a ceramic ring that is mounted at the base of the concave reflector of the incandescent illumination system (FIG. 1A), which in turn mounts the cylindrical, IR-reflective shroud.
Figure 1E:
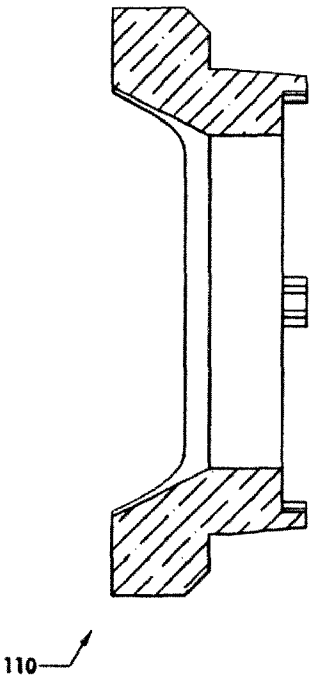
Figure 1C:
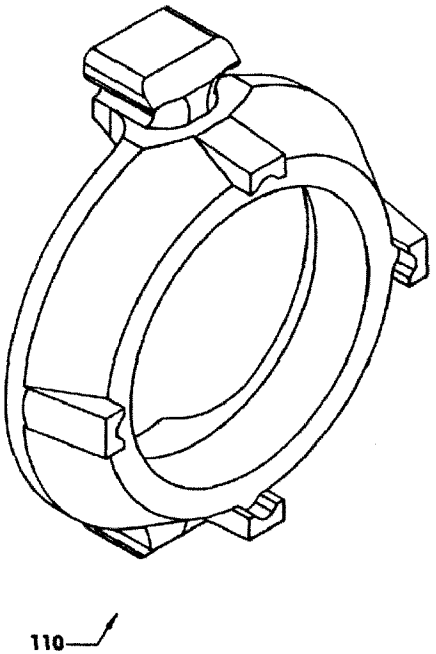
Figure 1G:
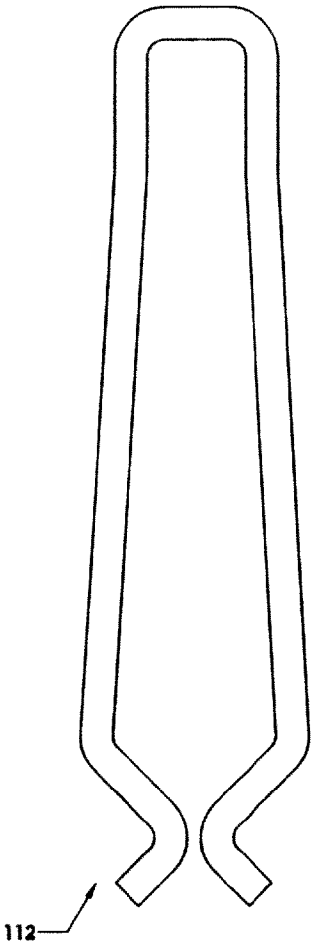
FIGS. 1F and 1G are isometric and side views, respectively, of one of two spring clips that mount the ceramic ring (FIGS. 1C-1E) to the base of the concave reflector of the incandescent illumination system (FIG. 1A).
Figure 1F:
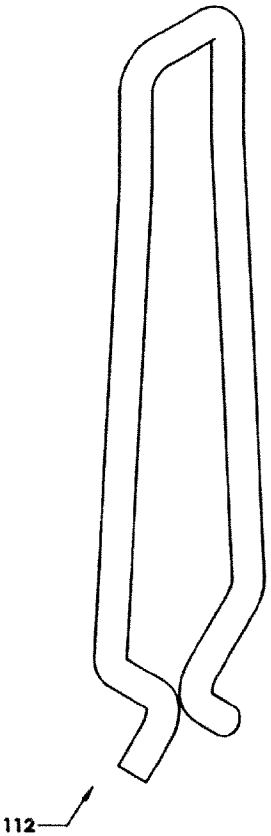
Figure 2A:
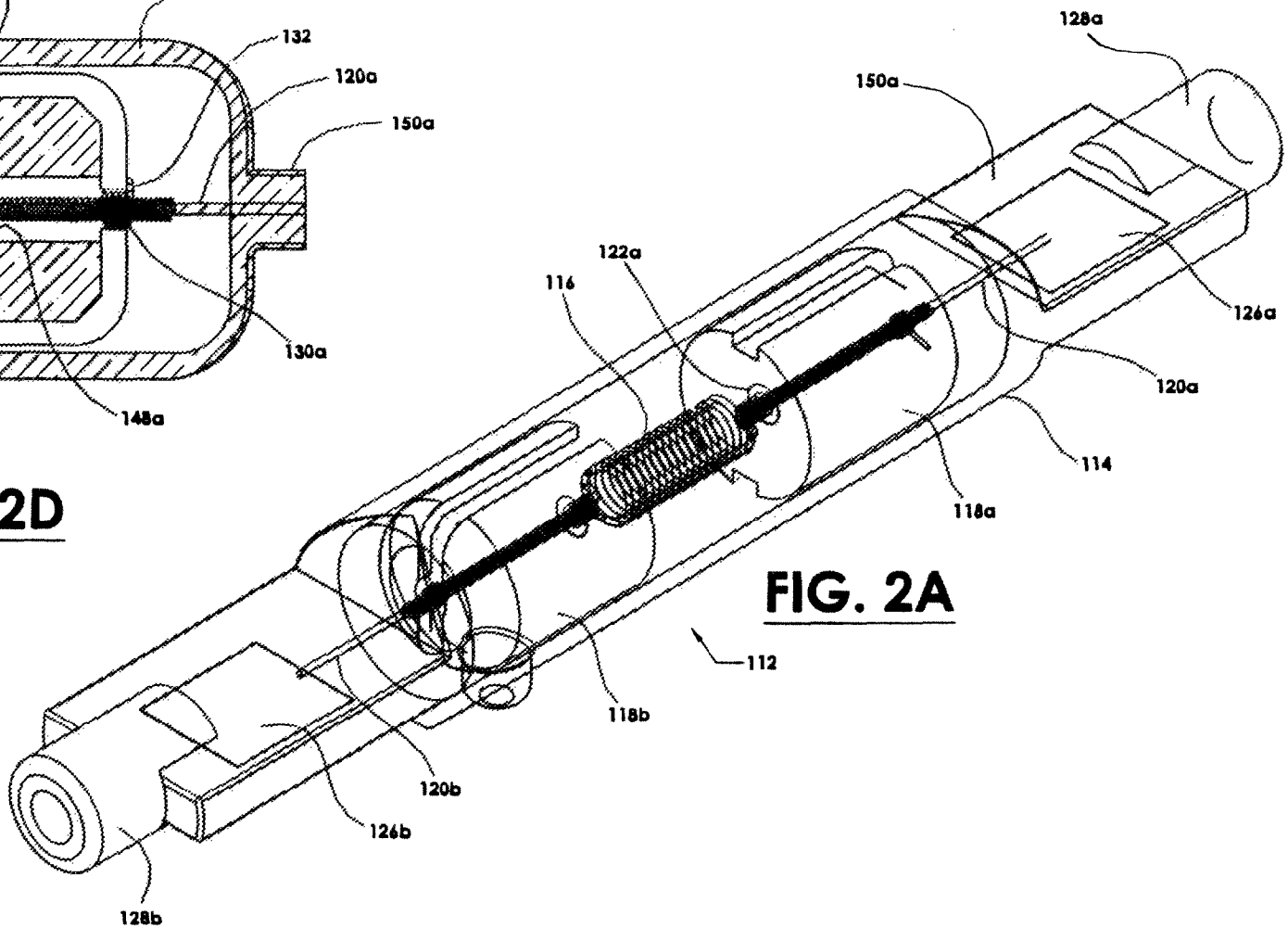
FIGS. 2A, 2B and 2C are isometric, top, and side views, respectively, of an incandescent lamp in accordance with one embodiment of the invention, the lamp including a single linear coil filament, a cylindrical envelope, and a pair of reflective filament supports that support the filament in a position concentric with the envelope.
Figure 2D:
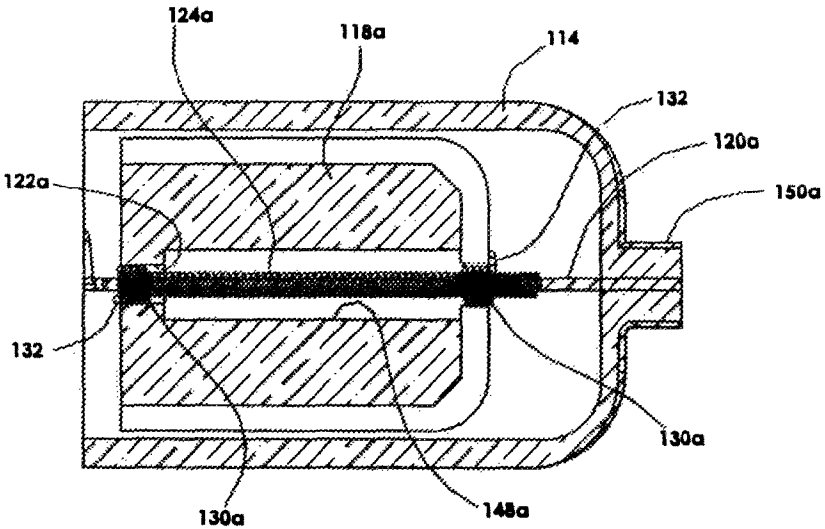
FIG. 2D is a detailed view of one end of the incandescent lamp of FIGS. 2A-2C, showing a lead aperture in one of the lamp's reflective filament supports, for slidably receiving one of two leads that deliver electrical power to the lamp's filament.
Figure 2C:
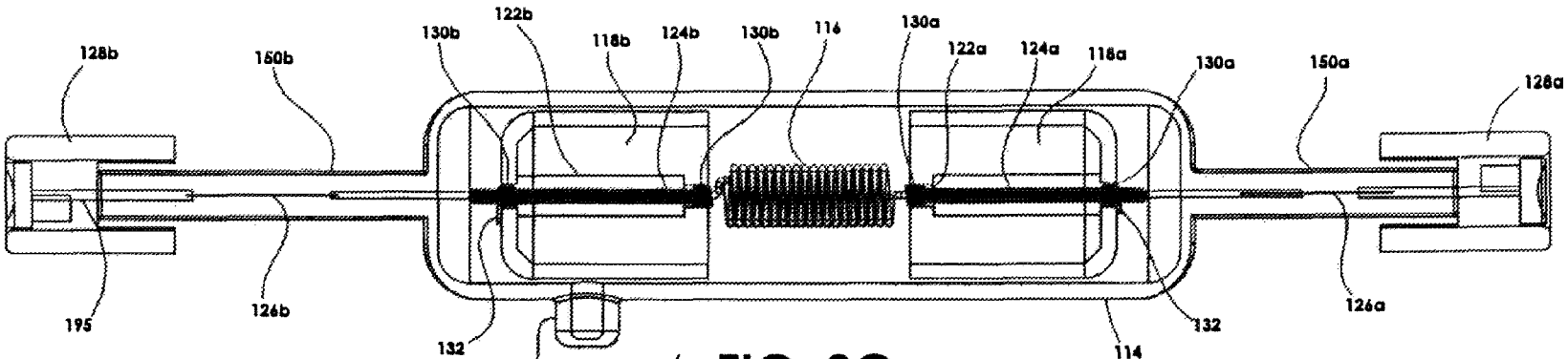
Figure 2B:
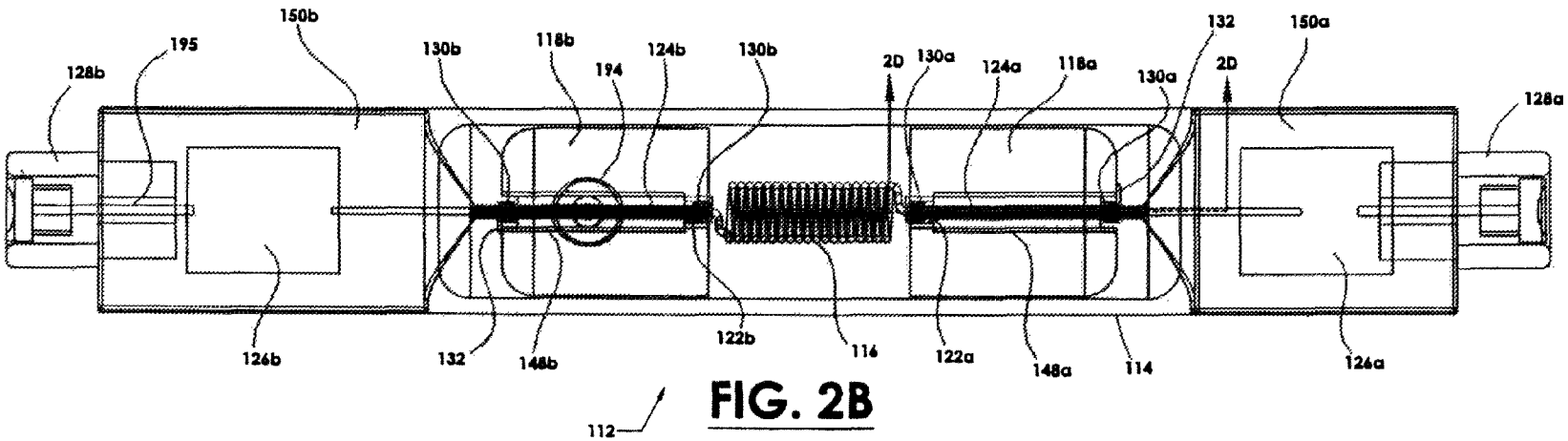

As best shown in FIGS. 1B and 1C, the ceramic ring 134 includes two attachment ears 144 that project outwardly from its opposite sides. These ears each receive the closed end of one of the spring clips 136, for securing the ceramic ring to the base plate 138 in a position substantially concentric with the nominal position of the incandescent lamp 100. It is recognized that the lamp envelope is not always precisely positioned relative to the lamp base, so the spring clips perform the important function of allowing the position of the ceramic ring to float slightly relative to the base plate. This ensures that removing and installing a lamp in the lighting fixture 102 will not cause the lamp envelope to abrade the inner surface of the surrounding shroud 108. Of course, additional spring clips alternatively could be used to secure the ceramic ring in place.

The inner diameter of the shroud 108 is sized to be slightly greater than that of the outer surface of the envelope of the lamp 100. Preferably, the shroud is sized to provide a spacing between it and the lamp envelope of about 0.50 mm. This spacing corresponds to about 4% of the envelope diameter.

The special coating system, which is described in detail below, is deposited onto the inner surface of the transparent shroud 108. In other embodiments (not shown in the drawings), the coating system can be deposited on the outer surface of the shroud or on both surface. This coating system is configured to reflect IR light received from the lamp 100, and to transmit visible light outwardly toward the concave reflector 104. The concave reflector, in turn, reflects this visible light in a forward direction to project a beam of visible light. The shroud reflects IR light received from the filament directly back to the filament, with low optical distortion. In addition, the shroud's cylindrical configuration reduces refractive scattering of visible light, as compared with non-cylindrical configurations, thereby improving the illumination system's luminous efficacy. The shroud substrate also can be made inexpensively, using readily available glass tubing.

The preferred material for the envelope of the lamp 100 is quartz, or fused silica glass, because of its high temperature rating (1000° C.), its excellent thermal shock resistance (0.7 μm/m° C.), and its high mechanical strength. The preferred material for the substrate of the shroud 108, on the other hand, is alumino-silicate glass, because its coefficient of thermal expansion (4.7 μm/m° C.) matches well with that of the coating system deposited onto it, because its high emissivity (about 0.82 at 500° C.) helps to limit the temperature of the shroud and thus the coating system, and because it has a moderately high temperature rating (700° C.) and a high thermal shock resistance.

With reference again to FIGS. 2A-2D, it is seen that the single filament 116 of the incandescent lamp 112 is located substantially coaxially within a cylindrical cavity whose cylindrical wall is defined by the encircling IR-reflective shroud 108, and whose end walls are defined by the two reflective, cylindrical filament supports 118*a*, 118*b*. Substantially all of the light emitted by the filament will be directed toward these components, i.e., either toward the cylindrical shroud or toward one of the two filament supports.

Visible light emitted by the filament 116 in the direction of the cylindrical shroud 108 is mostly transmitted through the lamp envelope 114 and the shroud, to the concave reflector 104 where it is reflected to form in the focused beam projected away from the lighting fixture 102. IR light emitted by the filament toward the shroud, on the other hand, is mostly reflected by the shroud back toward the filament. A portion of this reflected IR light will be absorbed by the filament, with the remainder either passing through the filament toward the opposite side of the encircling shroud or reflecting from the filament back toward either the shroud or one of the two reflective filament supports 118*a*, 118*b*. This process continues until the IR light is either absorbed by the filament, transmitted through the shroud, or absorbed by the envelope, the shroud, or one of the filament supports. Ultimately, a significant portion of this reflected IR light will be absorbed by the filament, to heat the filament and thus reduce the amount of electrical energy required to heat it to its operating temperature. This substantially increases the lamp's energy efficiency.

Substantially all of the visible and IR light emitted by the filament toward the two filament supports 118*a*, 118*b* is reflected back into the cylindrical lamp cavity, either toward the other filament support, toward the filament 116, or toward the encircling IR-reflective shroud 108. Most of the visible portion of this reflected light will be reflected by the other filament support, absorbed or reflected by the filament, or transmitted through the shroud and incorporated into the beam of light projected from the lighting fixture 102. Thus, most of this visible light will be used advantageously either by being incorporated into the projected beam of light or by being absorbed by the filament. On the other hand, most of the IR portion of this reflected light will be reflected multiple times by the shroud, the filament supports, and the filament until it eventually is absorbed by the filament. Efficiency can be enhanced by positioning the two filament supports as close as possible to the ends of the filament.

Ultimately, most of the visible light emitted by the filament 116 will be transmitted through the shroud 108 for incorporation into the projected beam, and most of the IR light emitted by the filament will be reflected back to the filament and absorbed. Very little visible or IR light will be lost to absorption by the reflective filament supports 118*a*, 118*b*, by the envelope 114, or by the coated shroud. This provides the incandescent illumination system with a very high energy efficiency.

The only IR light emitted by the filament 116 in a direction other than directly toward the coated shroud 108 or toward one of the two reflective filament supports 118*a*, 118*b* is the small amount of light emitted toward a narrow ring-shaped space 146 between the periphery of each filament support and the shroud. This is best seen in FIG. 1A. Although none of this IR light is recaptured, it represents a very small proportion of the light emitted by the filament.

The final turn at each end of the helical coil filament 116 diverges away from the adjacent helical turn, to reduce its temperature at the point where it extends into a lead aperture 122*a* or 122*b* in the adjacent filament support 118*a* or 118*b*. The ceramic material of the two filament supports is highly reflective, so it is important to minimize its temperature immediately surrounding the lead aperture 120*a*, 120*b*. To this end, the two lead apertures have counterbores 148*a*, 148*b* at their ends opposite the filament, to increase the spacing between the lead and the filament support.

As will be discussed in detail below, the filament supports 118*a*, 118*b* are formed of a highly reflective ceramic material, preferably aluminum oxide, or alumina. Persons skilled in the art will understand that other features of the lamp 112 and the process for making it, e.g., its lead structure and gas fill, can be in accordance with conventional practices. Also as will be discussed below, the lamp alternatively can include multiple filaments supported by this same kind of cylindrical-shaped, reflective filament support. The lighting fixture depicted in FIG. 1A accommodates such a multi-filament lamp.

The reflective filament supports 118*a*, 118*b* preferably are formed of a ceramic material having a high index of refraction and a varied grain size selected such that, when the material is sintered and pressed or molded into the desired shape with an appropriate amount of porosity (preferably 2-8%, or more preferably 3-7%), it will provide high total reflectance (i.e., specular and diffuse reflectance) over a broad wavelength range of about 400 to 5000 nanometers (nm). This reflection is produced by scattered surface reflection from the ceramic grains and by refraction and diffraction of the light from such grains and their crystalline interfaces and/or their adjacent voids. This provides a broadband, non-specular, diffuse reflection that is believed to follow a generally Lambertian reflectance pattern.

Figure 6:
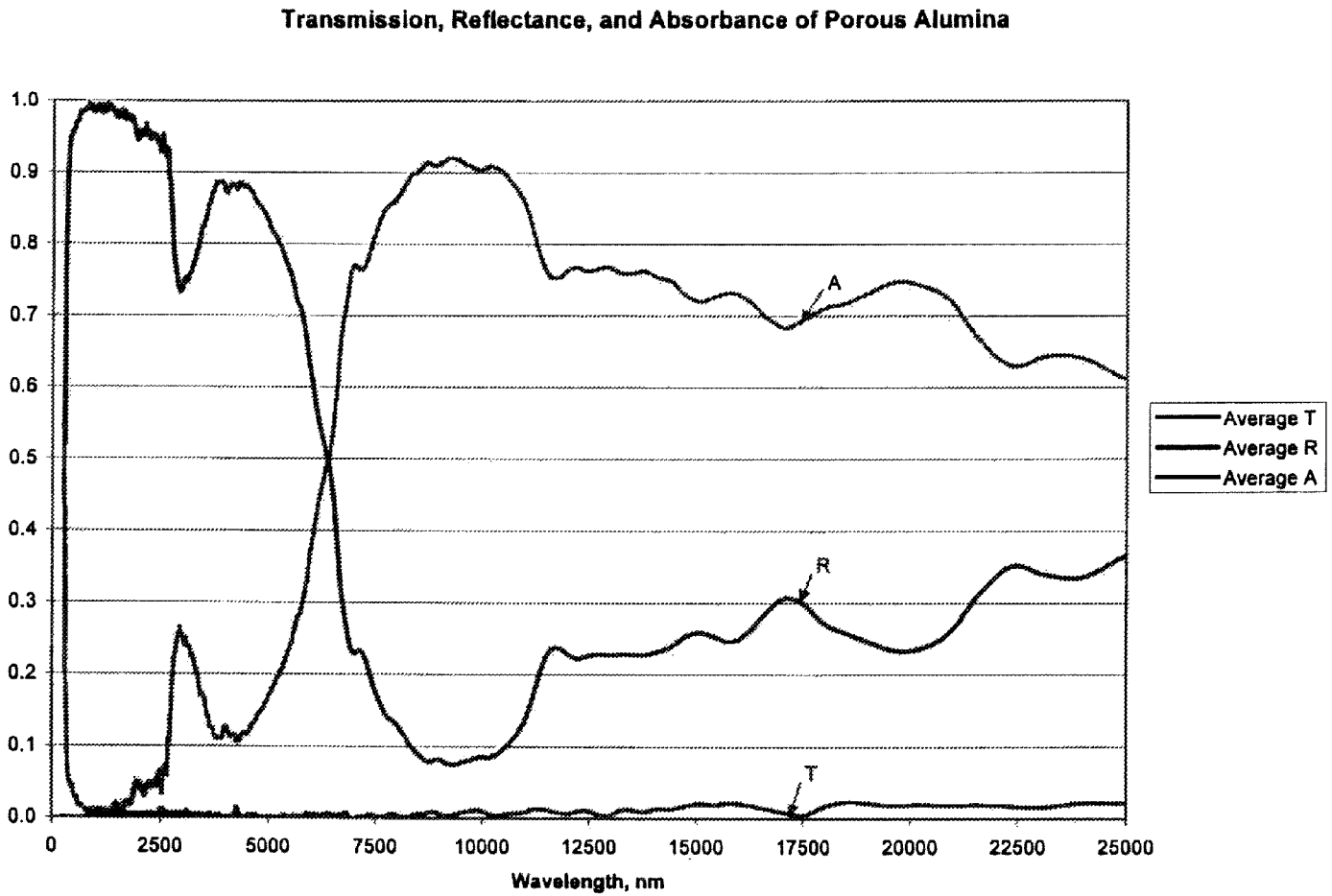
FIG. 6 is a graph depicting the average transmittance, reflectance, and absorbance of low-porosity, sintered alumina, which is the preferred material for the reflective filament supports of the incandescent lamp of FIG. 2A.

Suitable materials for the filament supports 118*a*, 118*b* include high-purity ceramic materials such as aluminum oxide, or alumina ($Al_2O_3$), or less preferably zirconium oxide, or zirconia ($ZrO_2$), magnesium oxide, or magnesia (MgO), or mixtures of these materials. Other high-temperature ceramic materials might also be suitable. These materials provide high broadband reflectance. For example, as shown in FIG. 6, the average reflectance of alumina is greater than 95% across a wavelength range of about 400 to 2500 nm. The identified materials also provide the advantages of being able to withstand the high temperatures associated with incandescent lamps and of being relatively inexpensive to produce by conventional ceramic molding and pressing techniques, which are well known in the art.

The reflective filament supports 118*a*, 118*b* alternatively can comprise fused silica ($SiO_2$), alumino-silicate, or silicon substrates having a coating of prescribed dielectric materials. These dielectric materials may include, for example, layers of silica and zirconia; layers of un-doped silicon, silica, and zirconia; or layers of titanium dioxide and silica. Reference is made to U.S. Patent Application Publication No. 2009/0311521, the entirety of which is incorporated herein by reference.

Commercially available reflective ceramic materials such as CeraLase ceramics, supplied by CoorsTek, Inc., and Sintox AL ceramics, supplied by Morgan Advanced Ceramics, have been found to be unsuitable for use in quartz halogen lamps. This is due primarily to the ceramics having an undesired high degree of porosity (>10%) and open porosity (>1%), and also to their containing undesired amounts of trace materials such as calcia (CaO), magnesia (MgO), and silica ($SiO_2$) (>400 parts per million (ppm)).

It is well known that oxygen and hydrogen both can interfere with the well-known halogen cycle (which keeps the lamp envelope free of tungsten deposits). For this reason, appropriate steps should be taken when incorporating ceramic components within a lamp envelope to minimize the amount of hydroxyl groups and water absorbed in the components before the envelope is sealed. Since the lamp's ceramic filament supports 118*a*, 118*b* preferably comprise a metal oxide, they tend to absorb water from the atmosphere after sintering, during transportation and storage, and during assembly of the lamp 112. Metal oxides absorb water both by chemi-absorption and by physical absorption. The primary mechanism for water absorption in ceramics is chemi-absorption, wherein water in the atmosphere is dissociated and the resulting negatively charged hydroxyl ions bond to the positively charged metal atom of the metal oxide near the surface of the ceramic. This is represented by the following formula:

$$-M^{++}+H_2O \rightarrow -M\text{-}OH+\tfrac{1}{2}H$$

A secondary mechanism for water absorption in ceramics is physical absorption, wherein water molecules form hydrogen bonds with hydroxyl groups that have attached to the ceramic surface in the manner described above. The presence of a significant water band at 2700 nm is noted in the spectrum of the ceramic material shown in FIG. 6.

The commercially available alumina ceramics identified above (Ceralase and Sintox) generally have a high degree of interconnected pores, or open-porosity (up to 40%). This open porosity enhances the ceramic's reflectivity in the visible wavelengths. However, it also significantly increases the ceramic's effective surface area and, consequently, increases the number of attached hydroxyl groups and water molecules. It has been found that by more fully sintering the high-purity alumina that is used to make the filament supports 118*a*, 118*b*, the absorbed hydroxyl and water content can be greatly reduced. More fully sintering the alumina will moderately reduce the material's visible reflectivity, but it will have substantially no effect on the material's infrared reflectivity. Overall, the material's integrated reflectivity at 3200K decreases by only about 1%. The preferred alumina material for the two filament supports has a porosity in the range of about 2-8%, and most preferably about 3-7%. In addition, the preferred alumina material has fully closed pores or very low open, or apparent, porosity, preferably less than about 1%, or more preferably less than about 0.5%. In this way, the pores provide only a negligible increase in the material's actual surface area.

As mentioned above, another deficiency in commercially available reflective ceramics is their typical high concentration of trace elements. One trace element, calcium oxide, or calcia (CaO), has been determined to interfere with the halogen cycle at elevated temperatures. For that reason, this trace element should not be present in the filament supports of the present invention at levels greater than about 10 ppm. It is believed that CaO forms a low-temperature eutectic with $SiO_2$ and $Al_2O_3$ during the sintering process, leading to the formation of calcia-alumina-silicate (CAS) at the ceramic's grain boundaries. During operation of the lamp 112, any CAS present in the alumina filament supports 118*a*, 118*b* is transported along the material's grain boundaries to the surface, and from there is transported by a halogen cycle to the envelope wall where it is deposited as a white, translucent film. This film absorbs light and causes the lamp to overheat rapidly and fail. In addition, the CAS film scatters any visible light emitted by the filament 116, thus interfering with collimation of the light by the concave reflector 104.

For these reasons, in the preferred embodiment, the alumina of the filament supports 118*a*, 118*b* has a calcia concentration of less than about 10 ppm, a grain size distribution of about 1-50 microns, an average grain size in the range of about 5-15 microns, a pore size distribution of about 0.2-20 microns, an average pore size in the range of about 2-6 microns, a density of about 92-98%, or more preferably 93-97%, of the material's theoretical density (i.e., about 2-8%, or more preferably 3-7%, porosity), and a closed porosity or open (or apparent) porosity of less than about 1%, or more preferably less than about 0.5%.

Hydroxyl groups and water still can attach to the reduced surface area of the closed-porosity alumina during the cooling process in an atmospheric oven, or upon exposure to the atmosphere following removal from a $H_2$ oven. For this reason, additional steps should be taken to remove the hydroxyl groups and water prior to sealing the lamp 112. These steps may include any or all of the following:

1. After sintering or just prior to assembly, the ceramic supports 118*a*, 118*b* are heated in a vacuum oven for several hours at a temperature of at least 600° C. The parts may then be stored in dry nitrogen until assembled.

2. If the filament supports 118*a*, 118*b* are to be transported, they are packed in an inert, water-impermeable material (e.g., Teflon) filled with an inert gas (e.g., dry nitrogen) and then vacuum-sealed.

3. The amount of time that the filament supports 118*a*, 118*b* are exposed to the atmosphere during assembly is minimized. Prior to sealing the lamp envelope 114, the filament 116 may be energized to heat the ceramic supports to around 600° C. or more, and the envelope may be flushed with an inert gas (e.g., argon) and pumped under vacuum for a period of time (preferably at least two minutes and more preferably at least 10 minutes) to remove any residual contaminants.

The combination of forming the filament supports 118*a*, 118*b* from closed-porosity (or very low open porosity) alumina and removing residual absorbed water prior to sealing the lamp envelope 114 in the manner described above has been found to produce a lamp 112 having a substantially improved halogen cycle.

With continued reference to FIGS. 2A-2D, it will be appreciated that deposits of tungsten compounds and halogen compounds can form on the portions of the lamp envelope 114 located forward of the forward filament support 118*a* and rearward of the rearward filament support 118*b*. This occurs in part because these envelope portions are cooler during operation than the region adjacent the filament 116, i.e., between the two filament supports. To inhibit the formation of deposits in these cooler portions of the envelope, the size of the cavities between the filament supports and the lamp's pinched ends 150*a*, 150*b* should be minimized, eliminated, or filled with a material such as ceramic or a halogen-compatible glass. As an example, the incandescent lamp 112 of FIGS. 2A-2D incorporates ceramic filament supports that are configured to nearly completely fill the cavities at the ends of the lamp.

In an alternative approach, the temperature of the cavities at the ends of the lamp 112 can be raised so as to inhibit condensation of the tungsten and halogen compounds in them. This can be accomplished in several ways. For example, the cavities can be insulated, to prevent them from losing heat through conduction and radiation. Alternatively, the filament supports 118*a*, 118*b* can carry an emissive coating on their sides facing the end cavities, which increases IR radiation for absorption by the cavities' quartz walls. Further, the size of the filament supports can be increased so that they have more surface area, thus both decreasing the size of the cavities and conducting more heat into them. In one embodiment, the halogen gas for this type of lamp is hydrogen bromide (HBr), which effectively cleans the lamp envelope and ceramic supports at high temperatures.

Figure 3A:
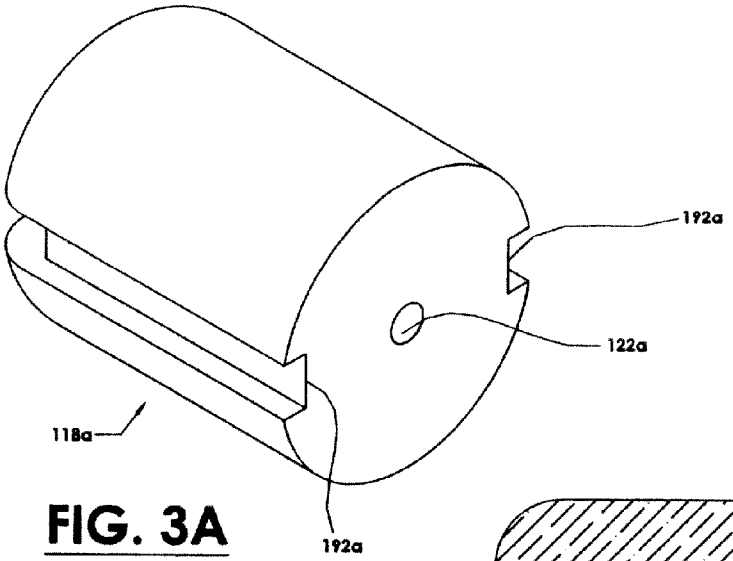
FIGS. 3A, 3B and 3C are isometric, side sectional, and rear face views, respectively, of a first embodiment of a reflective filament support that can be used in the incandescent lamp of FIG. 2A.
Figure 3C:
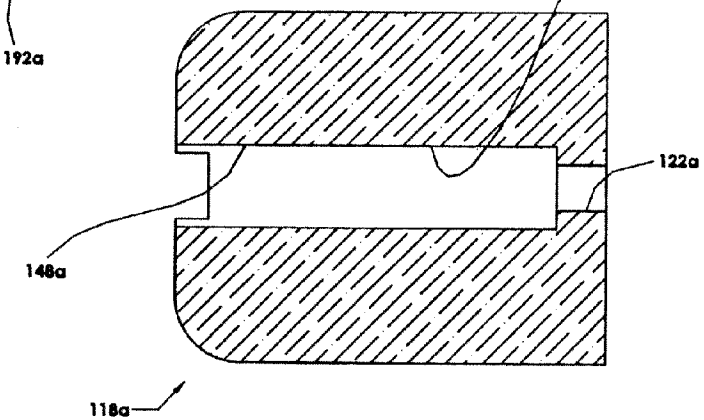
Figure 3B:
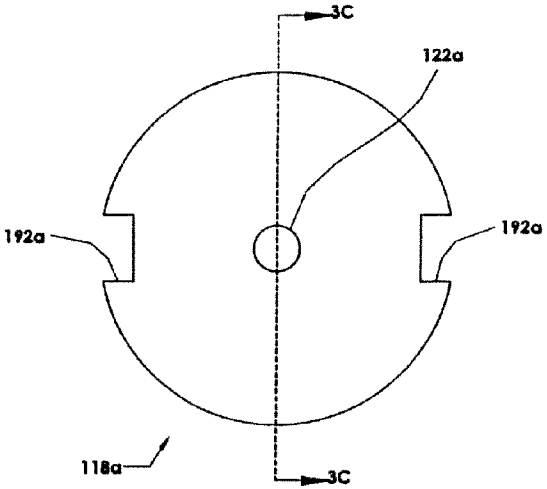

As discussed above, the two reflective filament supports 118*a*, 118*b* exhibit very low absorption in the wavelength range of light emitted by the filament 116, because of their high, broadband reflectivity in this range. Even so, the close proximity of the filament supports to the ends of the filament, and the intense visible and IR flux it produces, can heat the filament supports to a temperature that could adversely affect their microstructure and reflectivity. Forming the filament supports of alumina, which is highly conductive of heat, causes heat to be rapidly conducted to the back surfaces of the filament supports, which face away from the filament, for radiating away. As depicted in FIGS. 3A-3C, configuring the back surface, the cylindrical side surface, and the front surface of the filament supports to be smooth will be satisfactory in many cases. However, two alternative approaches for enhancing the elimination of excess heat also can be used.

Figure 4A:
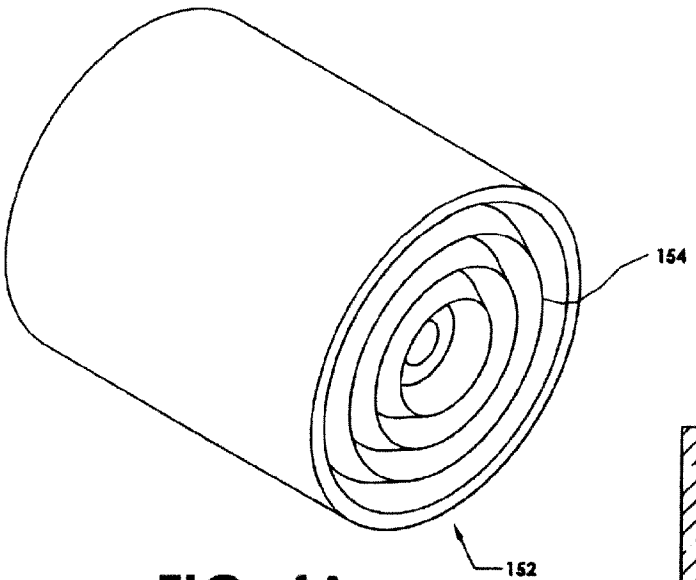
FIGS. 4A, 4B and 4C are isometric, side sectional, and rear face views, respectively, of a second embodiment of a reflective filament support that can be used in the incandescent lamp of FIG. 2A.
Figure 4C:
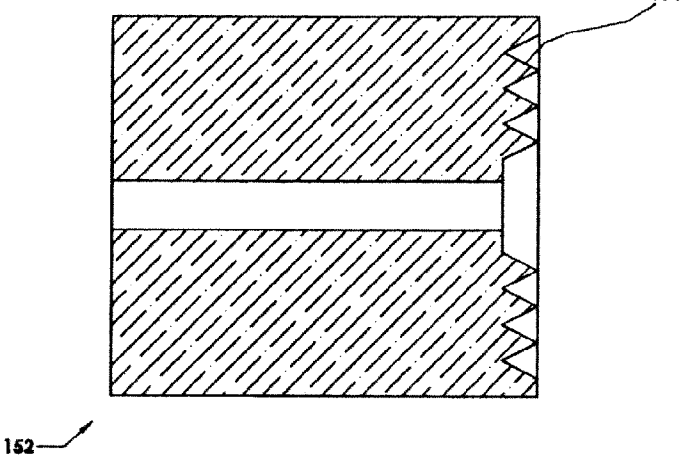
Figure 4B:
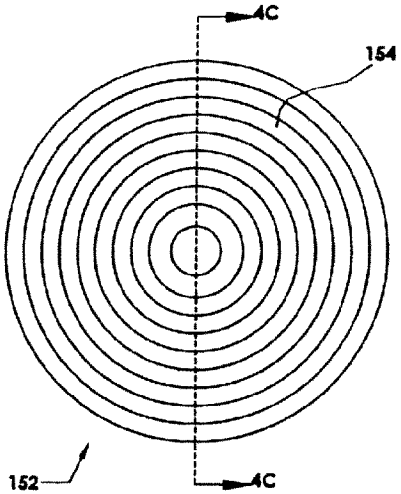
Figure 5B:
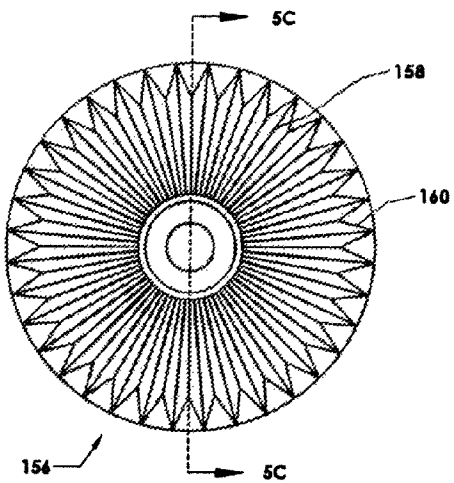
FIGS. 5A, 5B and 5C are isometric, side sectional, and rear face views, respectively, of a third embodiment of a reflective filament support that can be used in the incandescent lamp of FIG. 2A.
Figure 5C:
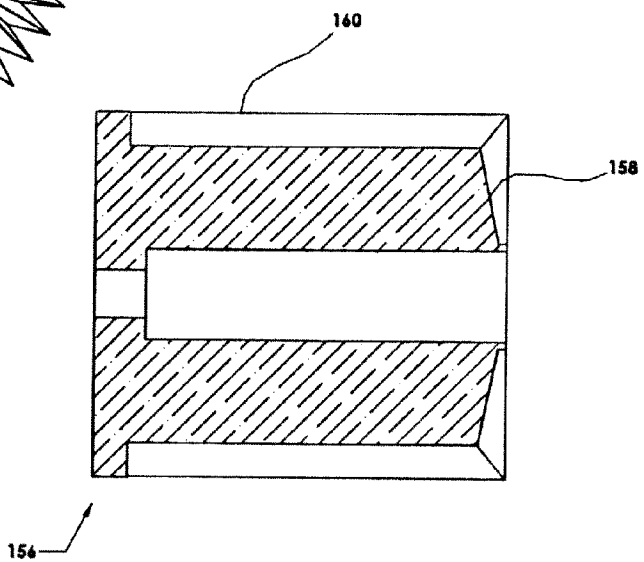
Figure 5A:
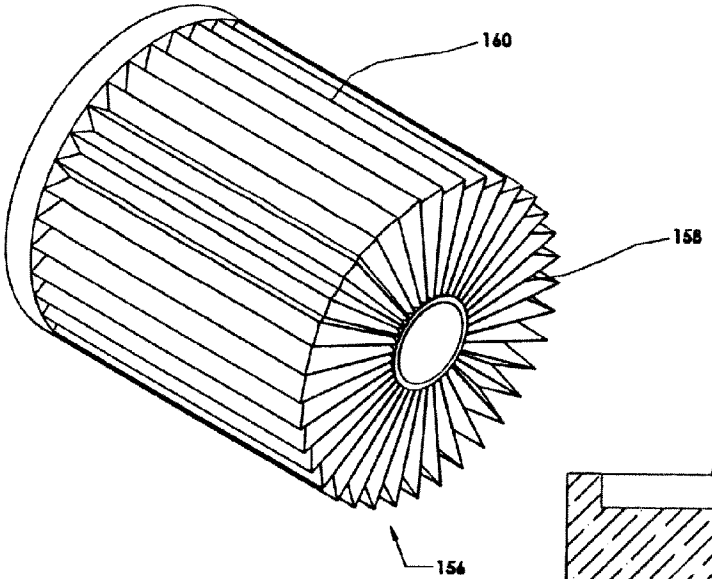

In one alternative approach, the backsides of the reflective filament supports are configured to have three-dimensionality so as to increase their surface area and enhance their ability to shed heat by radiation and convection. Two alternative configurations are depicted in FIGS. 4A-4C and FIGS. 5A-5C. In the configuration of FIGS. 4A-C, the filament support 152 has a back side that includes a uniform series of concentric, triangular-shaped grooves 154. The front and side surfaces are substantially smooth. In the configuration of FIGS. 5A-5C, the filament support 156 has a back side that includes a uniform series of radial grooves 158, which extend to become axial grooves 160 in a portion of the filament support's cylindrical periphery. The front surface is substantially smooth. The excellent moldability of alumina makes these alternative configurations readily achievable.

In another alternative approach, which can be used separately or in combination with the first approach, the back sides of the filament supports 118*a*, 118*b*, i.e., the sides opposite the filament 116, carry a special coating of a material having a high emissivity at or near the filament supports' maximum operating temperature. These coatings enhance the filament supports' ability to radiate heat and maintain the supports at a temperature sufficiently low to avoid damage to the supports' desired reflective properties. Preferably, the coating material has an emissivity that peaks at a wavelength of about 3 microns, which corresponds to the peak emission of a blackbody at a temperature in the range of 800 to 1000° C. Suitable coating materials include graphite or pure metals such as tantalum, zirconium, or niobium. The coating materials should be free of contaminants and should not adversely affect the lamp's halogen cycle. Any bromine compounds that might be formed with the emissive coating material should dissociate at a relatively low temperature, i.e., below about 500° C. The coatings can be applied using any of a number of conventional techniques, including sputtering and, in the case of graphite, ion beam sputtering, chemical vapor deposition (CVD), or chemical vapor infiltration (CVI). The coatings preferably have a thickness in the range of about 0.5 to 1.0 microns.

Figure 7A:
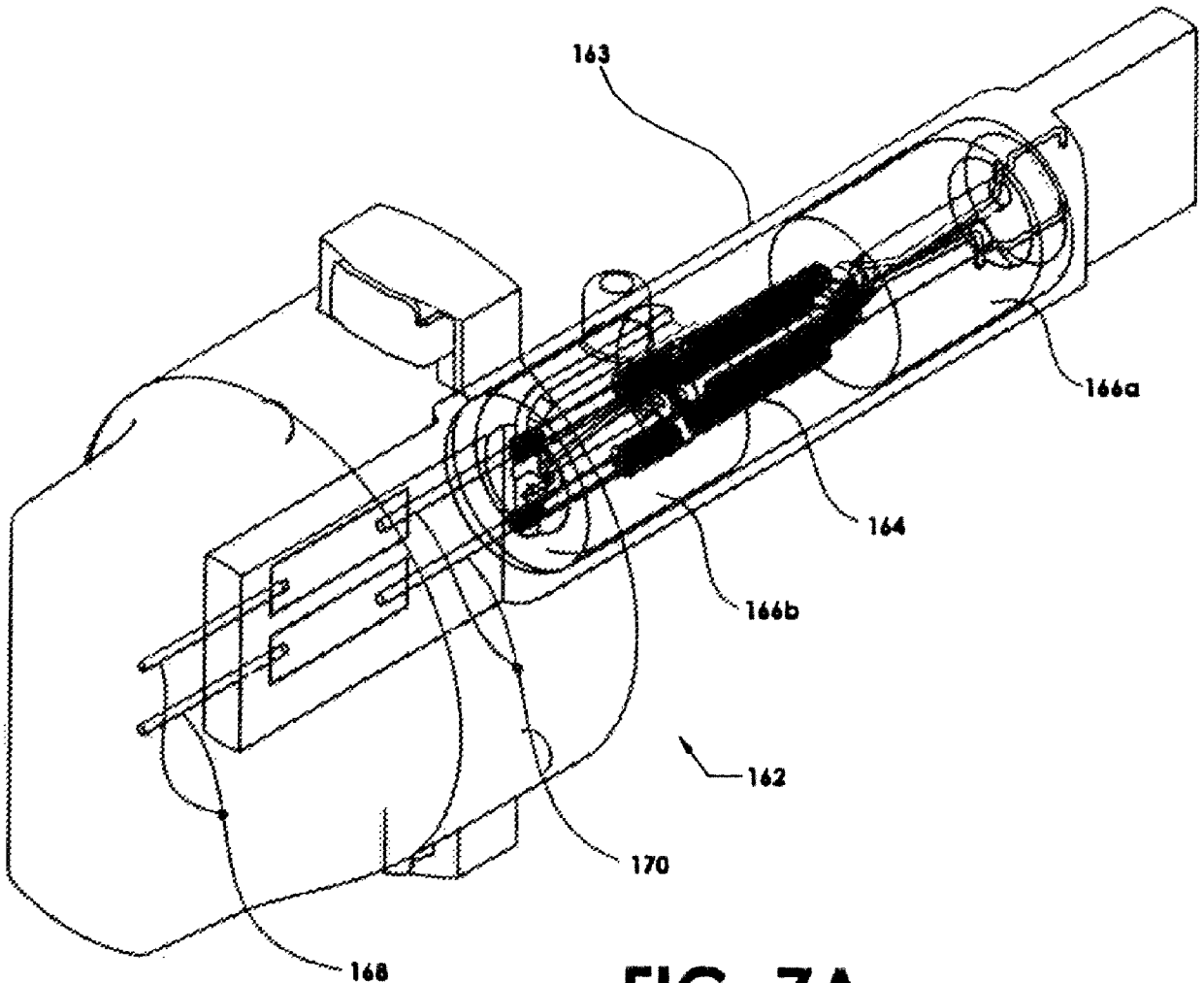
FIG. 7A is an isometric view of a single-ended incandescent lamp that is part of the incandescent lighting system of FIG. 1A, the lamp including four linear coil filaments, a cylindrical envelope, and a two reflective filament supports that support the filaments in a generally parallel relationship around the lamp's central longitudinal axis.
Figure 7C:
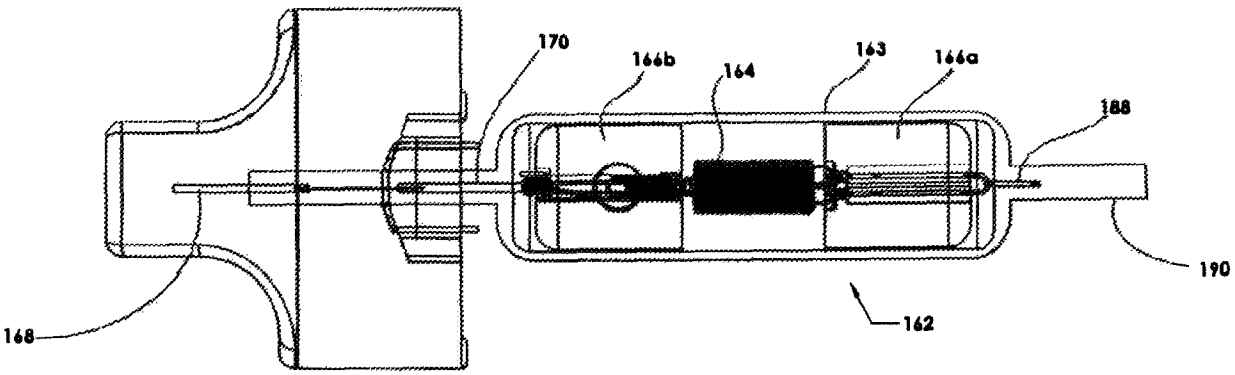
FIGS. 7B and 7C are top and side views, respectively, of the incandescent lamp of FIG. 7A.
Figure 7B:
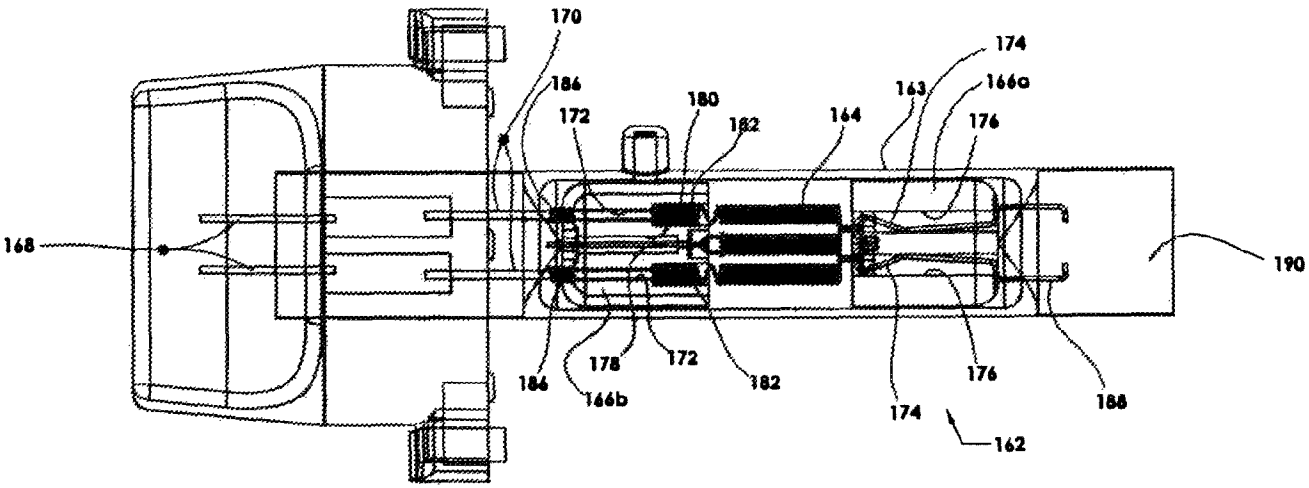
Figure 8B:
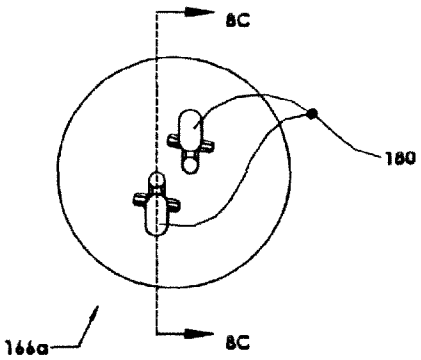
FIGS. 8A, 8B and 8C are front isometric, front face, and side sectional views, respectively, of the forward filament support of the incandescent lamp of FIG. 7A.
Figure 8E:
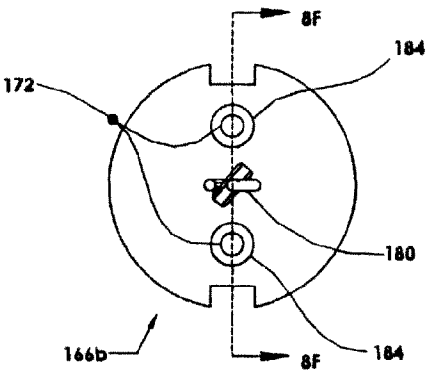
FIGS. 8D, 8E and 8F are front isometric, front face, and side sectional views, respectively, of the rearward filament support of the incandescent lamp of FIG. 7A.
Figure 8C:
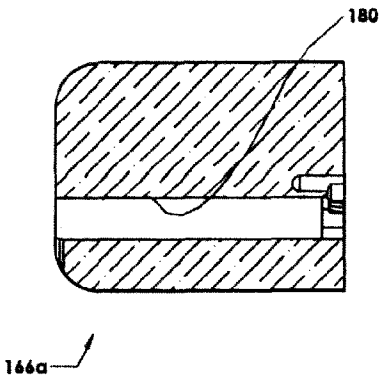
Figure 8F:
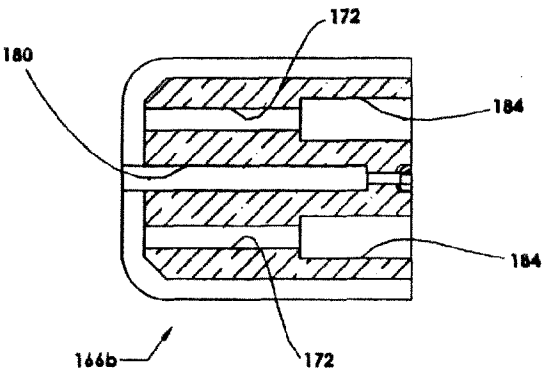
Figure 8A:
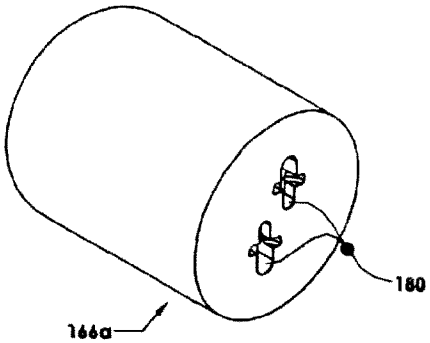
Figure 8D:
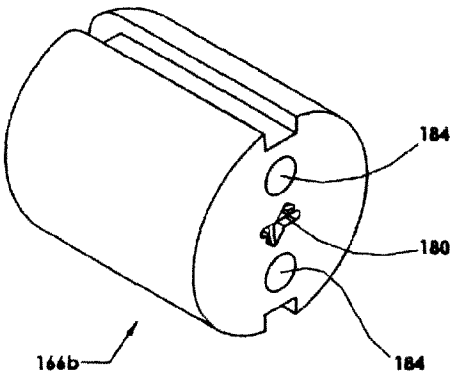

As discussed above, and as shown in FIG. 1A, alternative embodiments of the incandescent lamp can include more than just a single linear coil filament. One exemplary embodiment of such a lamp is depicted in FIGS. 7A-7C. The depicted lamp 162 includes an envelope 163 and four linear coil filaments 164 arranged around the lamp's central longitudinal axis, between forward and rearward reflective, cylindrical-shaped filament supports 166*a*, 166*b*. FIGS. 8A-8C are detailed views of the forward filament support 166*a*, and FIGS. 8D-8F are detailed views of the rearward filament support 166*b*. The lamp's two power connectors 168 connect via leads 170 to two of the filaments via lead apertures 172 formed in the rearward filament support 166*b*. The opposite ends of these two filaments connect via loops to the lamp's remaining two filaments while being supported by two tungsten support hooks 174 mounted in hook apertures 176 formed in the forward filament support 166*b*. Similarly, the opposite ends of these latter two filaments connect to each other via a loop that is supported by a single tungsten support hook 178 mounted in a hook aperture 180 formed in the rearward filament support 166*b*. These three tungsten hooks can be secured in their desired positions in the support hook apertures either by a snap-fit or by hooks or overwraps (not shown) located on the back sides of the two filament supports.

In the multi-filament lamp embodiment of FIGS. 7A-7C, the power leads 170 and the filaments 164 are separate components. The power leads are thick tungsten rods, and the filaments attach to these rods by wrapping around them in a helical fashion, as indicated by the reference numeral 182. These overwraps are located within counterbores 184 formed in the rearward filament support 166*b*, as best shown in FIGS. 7B and 8F. In these locations, the two helical overwraps are unable to absorb, or otherwise interfere with, light emitted by the lamp filaments. This rearward filament support is secured relative to the filaments by the overwraps 182 and by additional tungsten wire overwraps 186 wrapped around the power leads 170 where they emerge from the filament support's rearward side. The forward filament support 166*a*, on the other hand, is secured relative to the lamp envelope 163 and filaments by tungsten wire pins 188 that are held by the lamp's forward pinch seal 190.

With reference again to the single-filament incandescent lamp 112 of FIGS. 2A-2D, a proper assembly of the lamp is facilitated by providing the filament supports 116*a*, 116*b* with axial channels 192*a*, 192*b*, respectively, in their cylindrical side walls. This allows for the flow of nitrogen gas, or other non-reactive gas, through the envelope 114 while the ends of the envelope are being pinched closed. This gas flow is achieved using an exhaust tube 194 aligned with the channel 192*b* formed in the rearward filament support 116*b*. During assembly, the filament supports and the filament 116 are first assembled together and then inserted into the tubular envelope, after which the envelope's forward end is pinched closed over the thin forward molybdenum foil 126*a*, while nitrogen gas is pumped through the exhaust tube, the rearward channel 192*a*, the forward channel 192*b*, and out past the envelope's forward end. Thereafter, the envelope's rearward end is pinched closed over the thin rearward molybdenum foil 126*b*, while nitrogen gas is pumped through the exhaust tube, the rearward channel 192*b*, and out through the envelope's rearward end. During this pinching of the envelope's rearward end, a tension is applied to a rear power lead 195 connected to the foil 126*b*, to ensure that the filament 116 likewise is held in tension. The rear connector 128*b* subsequently is secured to this rear power lead.

Other pathways alternatively could be used to channel the nitrogen gas, or other non-reacting gas, during this sealing procedure. For example, in lamp embodiments incorporating multiple filaments and one or more support hooks, the hook apertures can be sized to facilitate this gas flow.

In general, when a multi-filament lamp includes an even number of filaments, the lamp preferably is single-ended, with its two power leads located together at the lamp's base, or rearward end, and with appropriate connections made between the remote ends of the separate filaments. On the other hand, when the lamp includes an odd number of filaments, the lamp preferably is double-ended, with the lamp's two power leads located at opposite ends of the envelope and with appropriate connections made between the leads and the filaments. Although the lamp 162 shown in FIGS. 7A-7C has the appearance of a double-ended lamp, with press seals at both of its ends, it actually is a singled-ended lamp, with both power connectors 168 located at its base end.

The use of the special reflective filament supports is particularly advantageous in multi-filament lamp embodiments, because the forward ends of the filaments can be supported by the forward filament support without the need for separate tungsten rods, as is conventional. Such tungsten rods are undesirable because they absorb light and/or reflect light in undesired directions, thus adversely affecting the lamp's energy efficiency. The special filament supports also are particularly advantageous in multi-filament embodiments, because they facilitate a precise alignment of the multiple filaments, thus improving the collection of IR light on the filaments, and also because they function well to electrically insulate the multiple filaments from each other. The use of these special filament supports in multi-filament lamp embodiments also can eliminate the end losses associated with conventional short linear-type lamps.

Figure 9A:
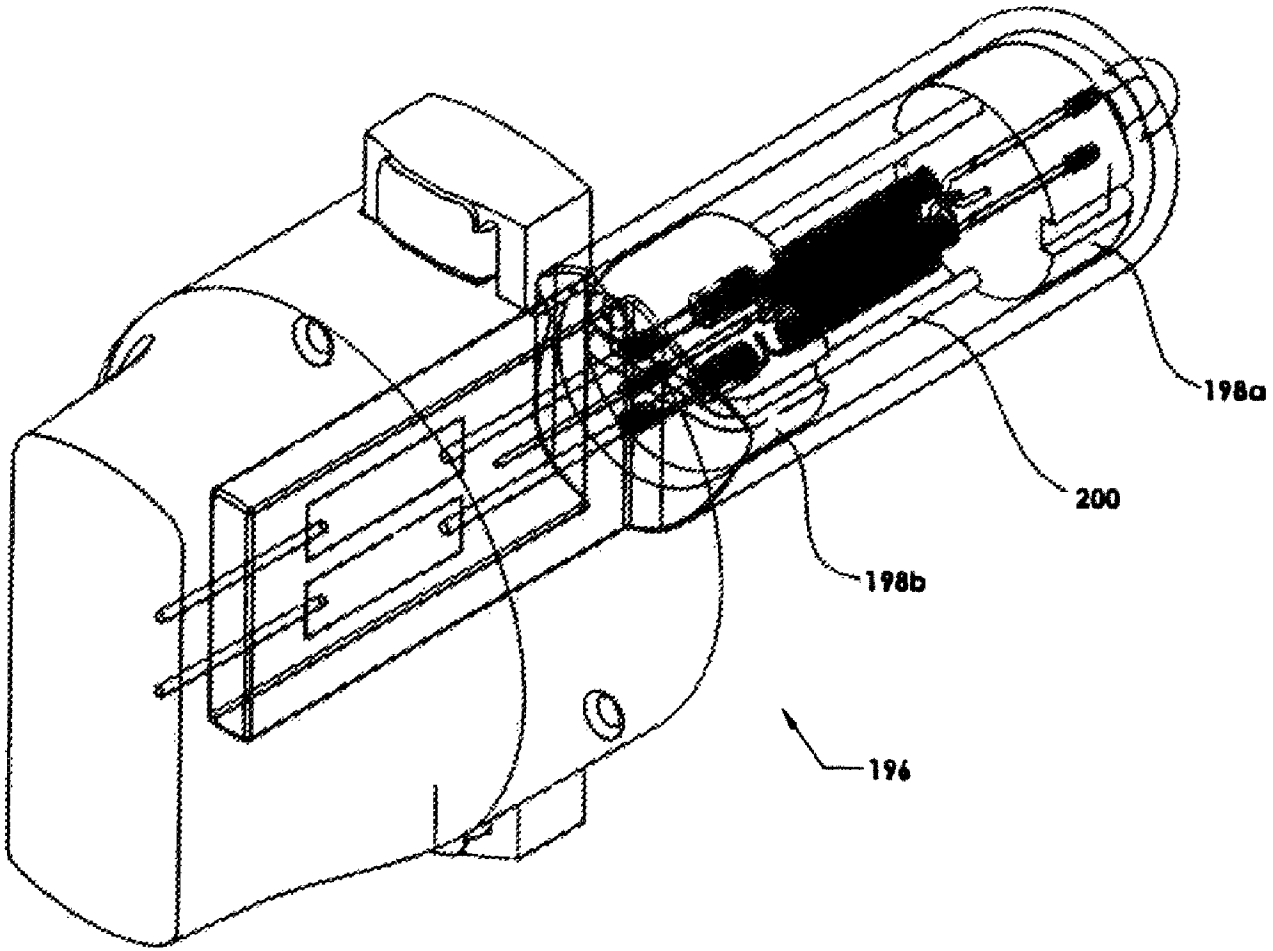
FIG. 9A is an isometric view of a second embodiment of a single-ended incandescent lamp that can be used in the incandescent lighting system of FIG. 1A, the lamp differing from the lamp of FIG. 7A in that it includes two transparent quartz rods for securing the forward filament support in its prescribed position within the lamp envelope.
Figure 9C:
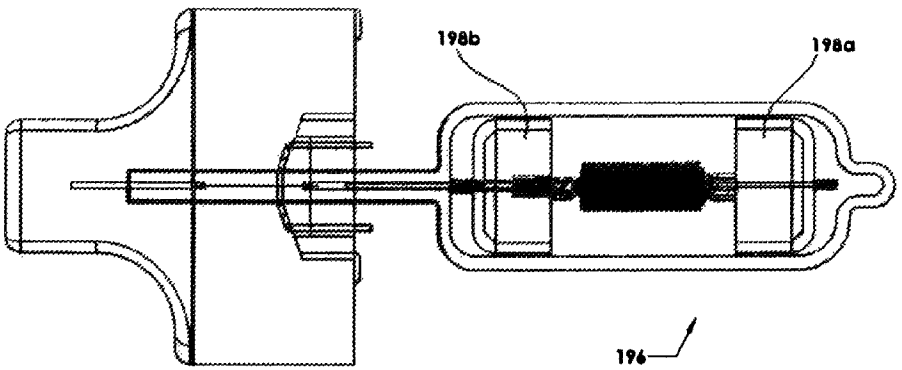
FIGS. 9B and 9C are top and side views, respectively, of the incandescent lamp of FIG. 9A.
Figure 9B:
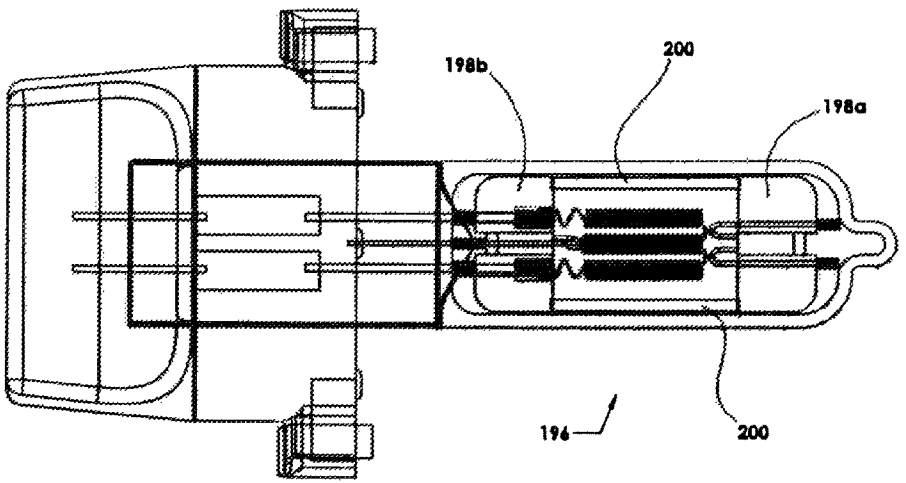

In some instances, it may be desirable to produce a lamp having its exhaust tube at the lamp's forward end, for manufacturing simplicity. This type of lamp is usually referred to as a "single-ended lamp." FIGS. 9A-9C depict a lamp 196 lacking a pinch seal at its forward end, but with its forward filament support 198*a* being held in place by two transparent quartz rods 200. These rods are considered to have only a small effect on the lamp's luminous efficacy. Alternatively, the forward filament support can be held in place by a rectangular support (not shown).

As discussed above, the shroud 108 includes a cylindrical substrate that carries on its inner surface a special optical coating system for reflecting IR light but transmitting visible light. The portions of the shroud located axially beyond the forward and rearward filament supports 116*a*, 116*b*, of course, need not be coated. Suitable IR-reflective coatings include PICVD coating produced by Auer Lighting located in Bad Gandersheim, Germany, as well as those disclosed in U.S. Patent Application Publication Nos. 2006/0226777 and 2008/0049428, the entireties of which are incorporated herein by reference.

In one preferred embodiment, the special optical coating system includes an IR-reflective dielectric coating on the substrate's inner surface and an optional anti-reflective coating (of visible light) on the substrate's outer surface. This combination of coatings has low visible light scattering and is relatively inexpensive to produce. The anti-reflective coating on the substrate's outer surface can include as few as four dielectric layers with a combined thickness of less than 0.5 microns and can reduce visible light reflection to about 0.5% or less. This anti-reflective coating might sometimes function even better than a much thicker IR-reflective coating, because it reduces the undesired scattering of visible light in directions away from the concave reflector.

An alternative optical coating system, which is disclosed in the published patent applications identified above, includes a combination of two distinct coatings: (1) a dielectric coating including a plurality of dielectric layers having prescribed thicknesses and refractive indices (e.g., alternating high and low indices); and (2) a transparent conductive coating (TCC) including a transparent, electrically conductive material having a prescribed thickness and optical characteristics. The dielectric coating and TCC are configured such that each provides a prescribed transmittance/reflectance spectrum and such that the two coatings cooperate with each other and with the lamp's filament to provide the incandescent lighting system with a higher luminous efficacy than that of a corresponding lighting system lacking such a coating system.

In the published patent applications identified above, the dielectric coating and TCC were specified as being located in various positions on the lamp's transparent envelope, or on a separate transparent substrate located within the envelope, surrounding the filament(s). The two coatings were specified as preferably being located contiguous with each other. Suitable materials for the dielectric coating include silica ($SiO_2$), alumina ($Al_2O_3$), and mixtures thereof, for the low-index of refraction material, and niobia ($NbO_2$), titania ($TiO_2$), tantala ($Ta_2O_5$), and mixtures thereof, for the high-index material. Preferably, the TCC is formed of a p-doped material such as indium-doped tin oxide (ITO), aluminum-doped zinc oxide (AZO), titanium-doped indium oxide (TIO), or cadmium stannate. Also suitable, but less preferably, are n-doped materials such as fluorine-doped tin oxide (FTO) and fluorine-doped zinc oxide (FZO) or thin-film metallic materials such as silver (Ag), gold (Au), and mixtures thereof.

In the prior art, incandescent lamps incorporating infrared-reflective coatings typically have had such coatings located directly on the outer surface of the lamp envelope, itself. The outer surface has been selected because of difficulties in depositing coatings on the envelope's inner surface, and also because locating the coating on the inner surface can lead to undesired interactions between the coating and the halogen gas normally located within the envelope.

Difficulties can arise when a TCC is combined with a contiguous dielectric coating on a glass substrate. In particular, defects such as cracks and crazes can arise in the dielectric coating, which can lead to discontinuities in the TCC that adversely affect the TCC's performance. These defects are believed to be caused by mechanical stresses to the coating, which generally can be classified as intrinsic stresses and extrinsic stresses.

Intrinsic stresses are believed to be characteristic of the deposition process conditions, internal physical properties of the coating material, post-deposition annealing, and the total film thickness. These intrinsic stresses can be minimized by using deposition processes that are optimized to deliver specific stoichiometry, optimal packing density, and low levels of impurities.

Extrinsic stresses, on the other hand, are believed to be created by a mismatch in the rates of thermal expansion for the coating layers and for the glass substrate. If the substrate's temperature when the lamp is powered off or when it is at full power is substantially different from what the substrate's temperature had been during the deposition process, then significant stresses can arise between the coating and the substrate.

For example, if dielectric coating materials having a high coefficient of thermal expansion (CTE), such as titania ($TiO_2$) or tantala ($Ta_2O_5$), are deposited onto a substrate material having a low CTE, such as fused silica, at a temperature significantly higher than the substrate's temperature when the lamp is powered off, then the coating will undergo a significant tensile stress when the lamp later is in its full power state. On the other hand, if such coating materials are deposited onto the substrate at a temperature significantly lower than the substrate's temperature when the lamp is in its full power state, then the coating will undergo a significant compressive stress when the lamp later is in its full power state.

Conversely, for dielectric coating materials having a CTE that is comparatively lower than that of the substrate, if the materials are deposited onto the substrate at a temperature significantly higher than the substrate's temperature when the lamp is powered off, then the coating will undergo a significant compressive stress when the lamp later is powered off. On the other hand, if such materials are deposited onto the substrate at a temperature significantly lower than the substrate's temperature when the lamp later is in its full power state, then the coating will undergo a significant tensile stress when the lamp is in its full power state. For these reasons, the dielectric materials preferably are deposited at a temperature intermediate 25° C. and the temperature of shroud's transparent substrate when the lamp is operated at full power. Typically, this will be in the range of 350-450° C.

Intrinsic and extrinsic stresses both contribute to the final tensile or compressive state of the deposited coatings. Coatings generally can handle compressive stress significantly better than they can handle tensile stress. Tensile stress is particularly detrimental to the coating's integrity and can cause the coating to crack, craze, and/or peel from the substrate. If the TCC is located adjacent to, and overlaying, the dielectric coating, such cracking, crazing, and peeling can lead to discontinuities in the TCC, which can adversely affect the TCC's performance.

Figure 11:
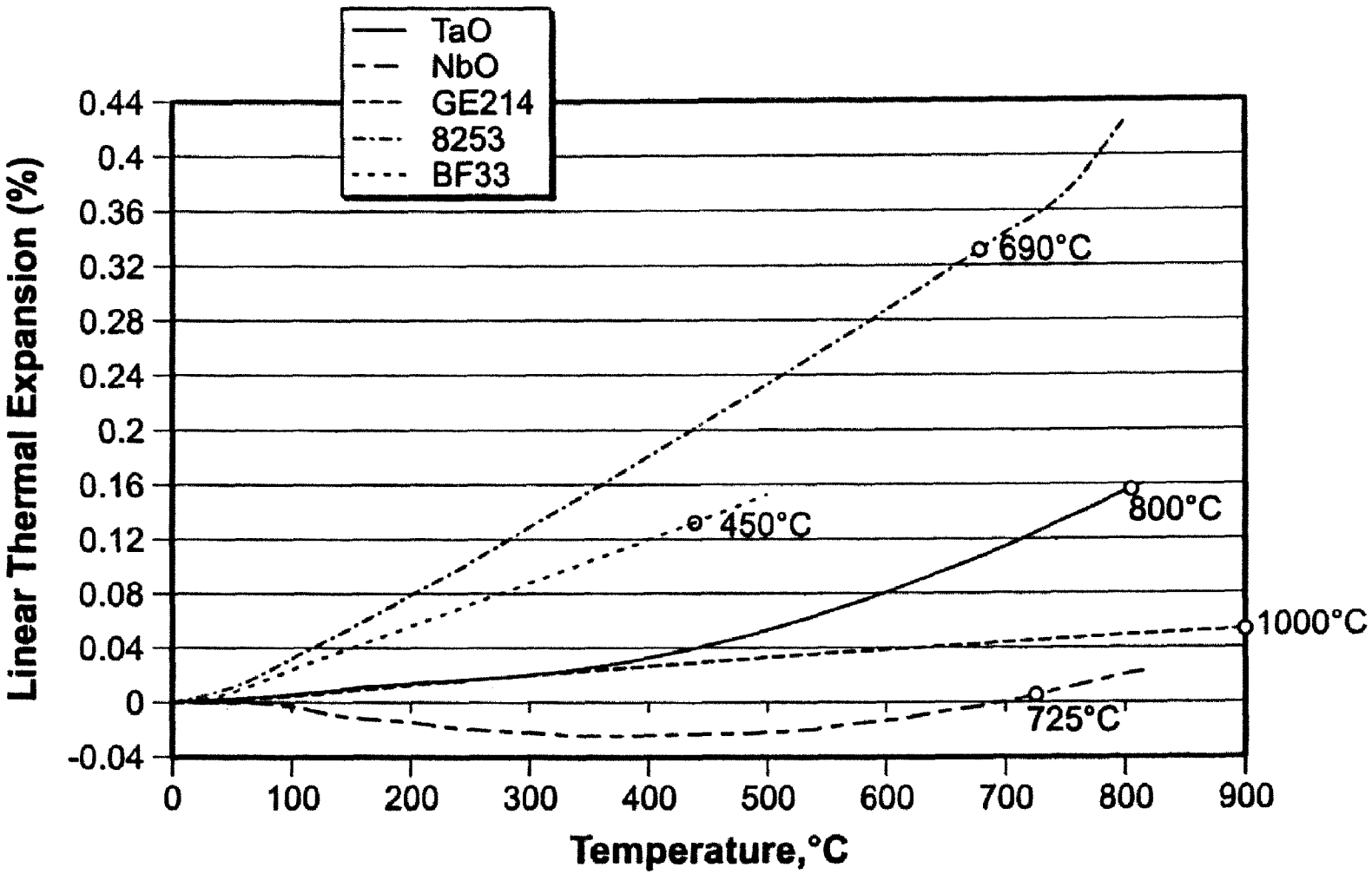
FIG. 11 is a graph depicting the linear thermal expansion coefficients for various materials, including tantala, niobia, and several alternative transparent glasses, over a temperature range of 0 to 900° C.

Extrinsic stress in the dielectric coating can be reduced by selecting dielectric materials having CTEs similar to, or slightly lower than, that of the glass substrate. The linear expansion with temperature of several materials is set forth in FIG. 11. One high-index dielectric material such as niobia (NbO), when deposited onto a fused silica substrate at a moderate temperature in the range of 200 to 300° C., can operate at temperatures as high as 700 to 800° C. without cracking. This is because niobia has a CTE that is slightly lower than that of fused silica. Silica ($SiO_2$), which is suitable for use as the low-index material in most multilayer dielectric coating designs, has a relatively low CTE and also is easily deformable because of its amorphous and flexible internal bond structure. Consequently, the extrinsic stress in a multilayer optical design largely is determined by the choice of the high-index dielectric material.

In one feature of the invention, the substrate of the shroud 108 and the high-index material of the dielectric coating have CTEs that differ from each other by no more than a factor of 2.5. This can prevent cracking of the dielectric coating and, consequently, can provide a successful combination of the dielectric coating with a TCC. For example, titania can be used without cracking if the shroud is formed of an alumino-silicate glass. This is because titania has a CTE that is only about twice that of alumino-silica glass. (Titania's CTE is not shown in FIG. 11.) Consequently, a dielectric coating containing titania can be used in combination with a TCC such as ITO on a substrate formed of alumino-silicate glass, whereas the same coating combination could not be used effectively on a substrate formed of fused silica.

Diffusion Barriers

In addition to being adversely affected by temperature-induced cracking in the adjacent dielectric coating, p-doped TCCs can also be adversely affected by the presence of oxygen at elevated temperatures. Oxygen is present in the atmosphere and also can be released from some of the oxides in the dielectric coating itself. In one feature of the invention, an oxygen diffusion harrier, such as silicon nitride ($Si_3N_4$), is deposited above and below a p-doped TCC such as ITO. Such a barrier is believed to block oxygen diffusion into the TCC at elevated temperatures and prevent a subsequent loss of carrier density and IR reflectivity. Such diffusion barriers are incorporated into the coating system depicted in FIG. 10A.

Figure 12:
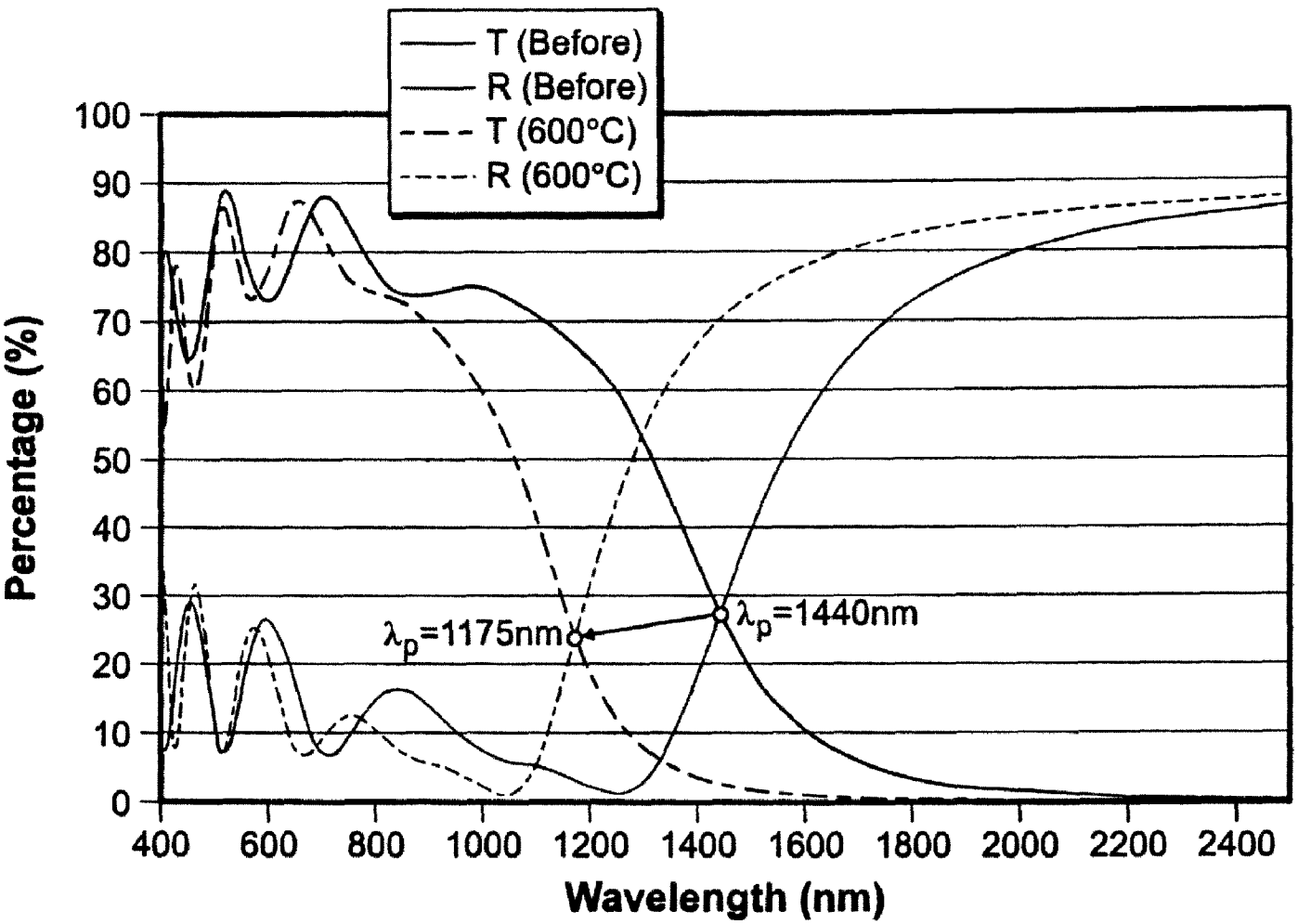
FIG. 12 is a graph depicting the transmission and reflection of indium-doped tin oxide both before and after operation at 600° C., over a wavelength range spanning from 400 to 2500 nm.

The presence of an oxygen diffusion barrier to prevent oxidation of the TCC, in combination with operating the TCC at elevated temperatures, also is believed to provide the benefit of promoting grain growth in the TCC. This can reduce the number of surface trapped states, which in turn can increase the TCC's carrier concentration, plasma frequency, and IR reflectivity. This effect is depicted in FIG. 12 for ITO, which shows a reduction in plasma wavelength from 1440 nm to 1175 nm.

As mentioned above, p-doped TCCs are preferred, but N-doped TCCs also are suitable. N-doped TCCs, such as fluorine-doped tin oxide (FTO) and fluorine-doped zinc oxide (FZO), are inherently more stable in an oxygen atmosphere at high temperatures than are p-doped TCCs. This is because n-doped TCCs do not depend on oxygen vacancies for their high conductivity and IR reflectivity. Nevertheless, fluorine-doped TCCs still preferably include a diffusion barrier, such as silica ($SiO_2$), alumina ($Al_2O_3$), or silicon nitride ($Si_3N_4$), to prevent the fluorine from diffusing out of the TCC.

If the diffusion barrier associated with an n-doped TCC is a low-index material, such as $SiO_2$ or $Al_2O_3$, it also acts as an index-matching layer. On the other hand, if the diffusion barrier is a high-index material, such as $Si_3N_4$, an index-matching layer of $SiO_2$ preferably is added to the coating.

Fluorine doping, which substitutes fluorine for oxygen, also yields superior optical performance as compared with metallic dopants, in materials such as tin oxide and zinc oxide. A theoretical understanding of this performance advantage is provided by considering that the conduction band of oxide semiconductors is derived mainly from metal orbitals. If a metal dopant is used, it is electrically active when it substitutes for the primary metal. The conduction band thus receives a strong perturbation from each metal dopant, the scattering of conduction electrons is enhanced, and the mobility and conductivity are decreased. In contrast, when fluorine substitutes for oxygen, the electronic perturbation is largely confined to the filled valence band, and the scattering of conduction electrons is minimized.

Oxygen diffusion barriers also can be used in connection with TCCs having the form of thin metallic layers of silver. Such diffusion barriers can prevent oxidation of the silver and subsequent loss of IR reflectivity at elevated temperatures. The diffusion barriers preferably are deposited using a technique that yields coatings that are very dense, free of pinholes, and contain no trapped oxygen. Exemplary techniques include sputtering, high-temperature chemical vapor deposition (CVD), and plasma-enhanced CVD (PECVD). In addition, an adhesion layer preferably is interposed between the silver layer and the diffusion barrier. Such adhesion layers can prevent the silver from agglomerating at elevated temperatures. Suitable materials for the adhesion layers include, for example, nichrome ($NiCr_X$), and more preferably, nichrome nitride ($NiCrN_X$).

Heat Dissipation

Dielectric/TCC coating systems preferably are operated at relatively low temperatures, to prevent degradation of the coatings and the resulting loss of IR reflectivity, even with the addition of oxygen diffusion barriers. In particular, coating systems incorporating TCCs in the form of p-doped and n-doped transparent conductive coatings preferably are operated at temperatures no higher than 600 to 700° C., and coating systems incorporating TCCs in the form of metallic coatings preferably are operated at temperatures no higher than 300 to 500° C.

The temperatures of the envelopes of conventional quartz halogen lamps typically are in the range of 700 to 900° C., and the temperature of the surrounding IR-reflective shroud should be expected to be slightly lower than this. For this reason, the preferred lower operating temperatures of the coating systems of the invention can optionally be achieved by increasing the surface area and size of the lamp envelope, and thus the shroud, as compared to conventional quartz halogen lamps. However, such an increase could lead to a loss of IR collection efficiency. A further complication is that a portion of the IR radiation that is not reflected by TCCs is absorbed, not transmitted. This increased absorption will increase the coated shroud's temperature.

It, therefore, will be appreciated that it is desirable to reduce the temperature of the coating system, without unreasonably increasing the sizes of the lamp envelope and shroud. This can be accomplished by increasing the coated shroud's emissivity and/or its convection coefficient. Alternatively, it can be accomplished by decreasing the power to be dissipated.

The lamp envelope and the shroud are cooled both by convection and by radiation. The total power removed from the shroud is represented by the following formula, at thermal equilibrium:

$$Q=Ah(T-T_A)+A\sigma\in(T^4-T_A^4)$$

Where: Q is the power dissipated (watts)

A is the shroud's outer surface area ($m^2$)

h is the shroud's convection coefficient ($W/(m^{2\cdot}{}^\circ K)$)

T is the shroud temperature (° K)

$T_A$ is the ambient temperature (° K)

$\sigma$ is the Stefan-Boltzmann constant ($W/(m^{2\cdot}{}^\circ K^4)$)

$\in$ is the shroud's emissivity (no units)

The radiation flux incident on different areas of the shroud 108 ordinarily is variable. This leads to variations in the thermal load and temperature for different areas of the shroud. In addition, the thermal conductivity of the shroud material inherently creates a thermal differential between the shroud substrate's inner and outer surfaces, and it will contribute, to at least a limited degree, to equalizing the shroud's temperature profile.

As discussed above, the special optical coating system of FIG. 10A is located on the inner surface of the shroud 108, so the radiation of heat away from the shroud can advantageously be enhanced by a proper selection of the substrate material. To this end, the substrate preferably is formed of a material having high weighted average IR emissivity in the wavelength range corresponding to the wavelength range of the radiation produced by a black body operating at the same temperature as the shroud (e.g., 1,500 to 10,000 nm for 700° C.). The optimum material is alumino-silicate glass (e.g., Schott #8252. Schott #8253, and G.E. #180).

Figure 13:
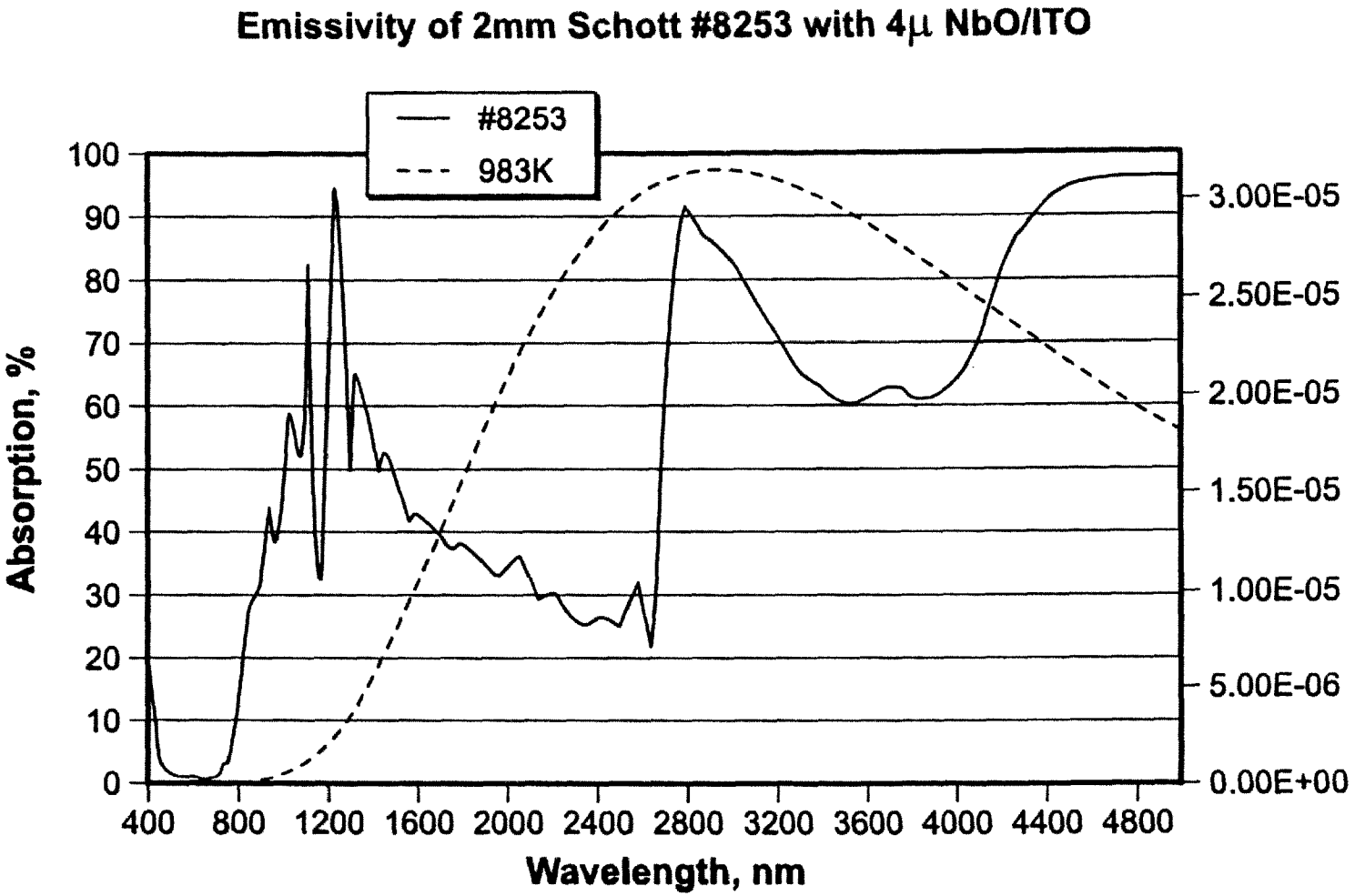
FIG. 13 is a graph depicting the emissivity of a 2 mm-thick sheet of alumino-silicate glass (Schott #8253), in combination with a niobia/indium-doped tin oxide (NbO/ITO) coating, and the spectral power distribution of a black body at 983° K (710° C.). The integrated product of the two curves yields a value proportional to the energy emitted by the glass at that temperature.

The emissivity of alumino-silicate glass (e.g., 2 mm Schott #8253) in combination with a NbO/ITO coating is shown in FIG. 13. Note that this material has an emissivity greater than 0.60 above 2700 nm.

Figure 14:
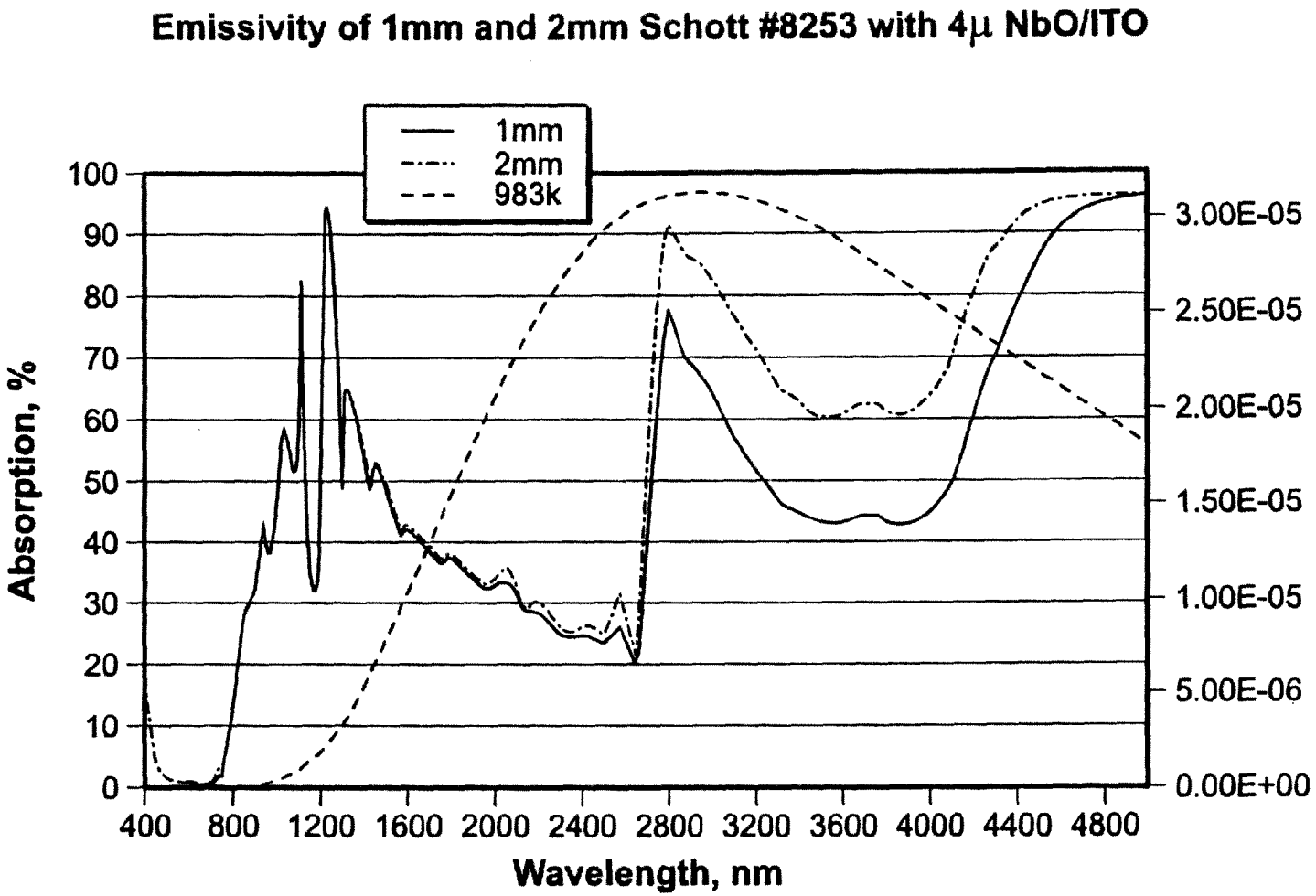
FIG. 14 is a graph depicting the emissivity of 1 mm-thick and 2 mm-thick sheets of alumino-silicate glass (Schott #8253), in combination with a 4 micron-thick coating of niobia/indium-doped tin oxide (NbO/ITO).

The substrate of the shroud 108 preferably is made as thick as possible, to increase its weighted average IR emissivity, without unduly increasing its visible absorption. The emissivity of 1 mm of coated Schott #8253 alumino-silicate glass is compared to the emissivity of 2 mm of the same coated glass in FIG. 14. Note that the emissivity of the 2 mm glass is substantially greater than the emissivity of the 1 mm glass above 2700 nm. A thick shroud advantageously increases the envelope's emissivity and its outer surface area while maintaining the same filament-to-coating distance if it retains the same internal diameter.

As mentioned above, FIGS. 10A-10C relate to one coating system embodiment configured in accordance with the invention, incorporating a dielectric coating and a TCC in the form of a p-doped material, deposited onto the inner surface of a shroud substrate formed of alumino-silicate glass. Depositing a coating system onto the substrate's inner surface can be more difficult than depositing it onto the substrate's outer surface, but the resulting coating system is beneficially located incrementally closer to the lamp's filament. This can increase the proportion of reflected light that impinges on the filament, where at least a portion of it is absorbed, thereby improving the lamp's luminous efficacy.

FIG. 10A is a schematic cross-sectional view depicting the coating system's successive layers. Specifically, the coating system includes a TCC in the form of ITO deposited directly onto the substrate's inner surface, which is overlaid by a multi-layer dielectric coating. A first $Si_3N_4$ oxygen diffusion barrier is located between the substrate and the TCC, and a second $Si_3N_4$ oxygen diffusion barrier is located between the TCC and the dielectric coating. Other oxygen diffusion barrier materials alternatively could be used.

FIG. 10B is a table setting forth the specific materials and thicknesses for each individual layer of the coating system of FIG. 10A. It will be noted that the dielectric coating incorporates 45 alternating layers of $Nb_2O_5$ and $SiO_2$. The ITO TCC preferably is selected to have a plasma wavelength of less than about 1400 nm. In FIG. 10B, the two $Si_3N_4$ oxygen diffusion layers are depicted as combining with the ITO layer to form the TCC. The combined thickness of all of the identified layers is calculated to be 4960 nm.

Figure 10C:
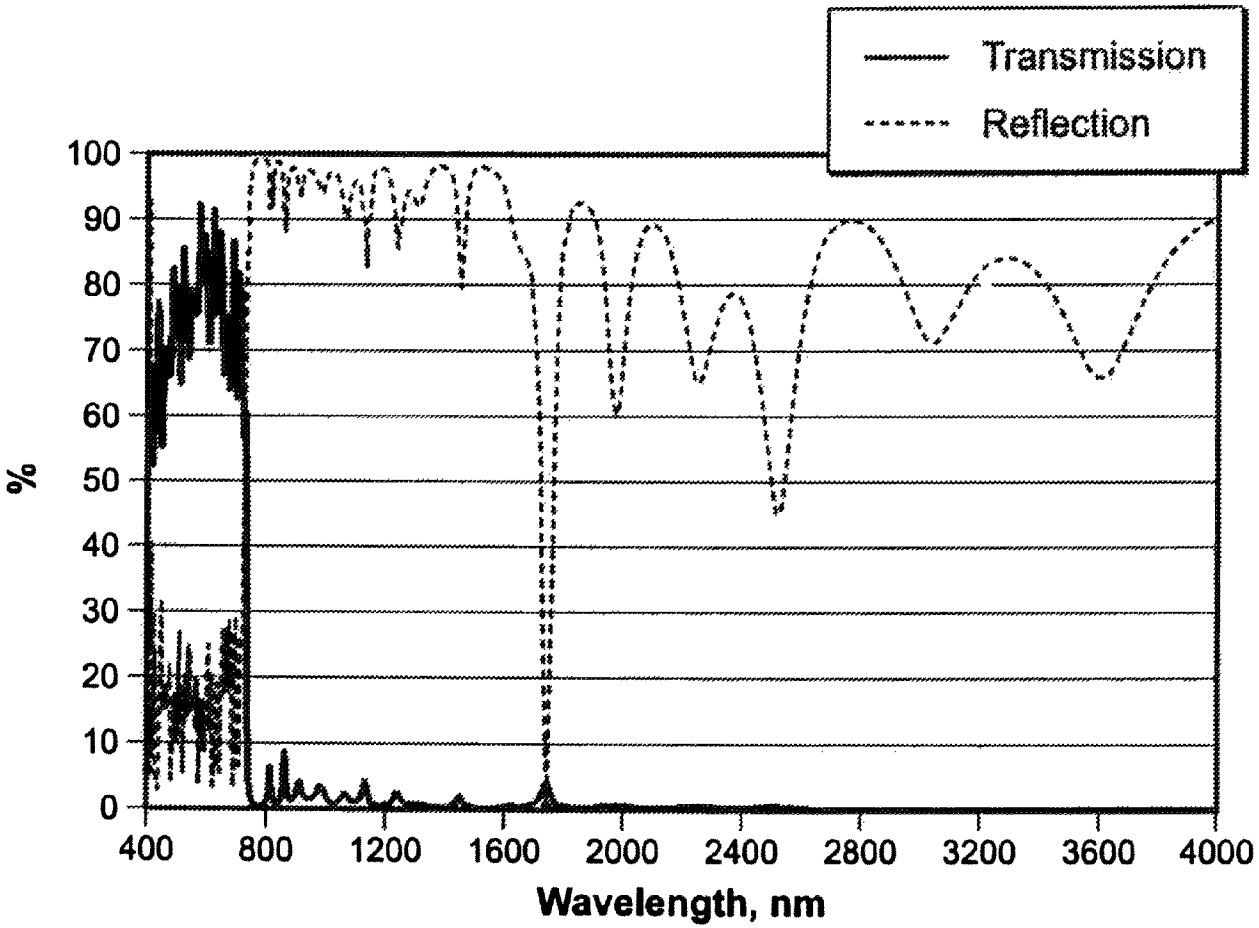
FIG. 10C is a graph depicting the transmission and reflection of the coating system of FIGS. 10A and 10B, over a wavelength range spanning from 400 to 4000 nm.

FIG. 10C is a graph depicting the coating system's transmission and reflection over a wavelength range spanning from 400 to 4000 nm. This depicted transmission and reflection are considered to represent a marked improvement in overall performance over that of a similar lighting system lacking a coating system.

In an alternative embodiment of the invention, not shown in the drawings, the IR-reflective shroud is positioned within the lamp envelope, rather than encircling it, in the region between the two reflective, cylindrical-shaped filament supports. This embodiment does not benefit from the cost savings realized by separating the IR-reflective coating from the lamp, thus allowing the coating to be retained when the lamp is replaced. Nevertheless, the embodiment can provide added energy efficiency by eliminating the small ring-shaped regions adjacent the peripheries of the cylindrical-shaped filament supports, where IR light otherwise would be unreflected and wasted.

It should be appreciated from the foregoing description that the present invention provides both an improved incandescent lamp and an improved incandescent lighting system. The improved lamp incorporates special reflective filament supports for both precisely positioning the lamp filaments(s) and reflecting both visible and IR light. The improved lighting system incorporates a special shroud surrounding the incandescent lamp, the shroud including a special optical coating system configured to more effectively reflect IR light back toward the lamp filament, thereby enhancing the lighting system's luminous efficacy. Multiple embodiments are disclosed, including coating systems incorporating either a dielectric coating alone or specific combinations of a dielectric coating and a transparent conductive coating.

It also should be appreciated from the foregoing description that the lighting system of the invention is cheaper to maintain than prior art systems of the kind that included an IR-reflective coating disposed on the lamp envelope itself. This is because, in the present invention, the coating need not be replaced when the lamp is replaced. In addition, the special reflective, cylindrical-shaped filament supports serve the dual function of both supporting the filament(s) within the lamp envelope and reflecting significant amounts of visible and IR light that otherwise might be wasted.

Further, the IR-reflective coating reduces the amount of IR radiation in the projected beam of light, thereby increasing the service life of any shutters, patterns, and color media that might be used in the lighting fixture. This is accomplished without using expensive, large area dichroic coatings on the concave reflector. This feature may also allow the use of plastic lenses and/or housing elements in the fixture. Plastic lenses are generally cheaper and lighter than glass, and plastic housing elements are generally cheaper and lighter than metal. This feature also reduces the amount of heat in the projected beam, which is beneficial when illuminating people and light-sensitive objects such as produce and artwork. Any long-wave IR light emitted by the shroud is defocused in the illumination system and should not produce significant heating from the projected beam.

The present invention has been described above in terms of presently preferred embodiments so that an understanding of the present invention can be conveyed. However, there are other embodiments not specifically described herein for which the present invention is applicable. Therefore, the present invention should not to be seen as limited to the forms shown, which is to be considered illustrative rather than restrictive.

What is claimed is:

1. An incandescent illumination system for projecting a beam of light, comprising:

an incandescent lamp comprising one or more filaments for emitting visible light and infrared light; and a lighting fixture configured to removably receive and retain the incandescent lamp, the lighting fixture comprising:

a socket for supporting the incandescent lamp in a prescribed position, a shroud surrounding at least a portion of the incandescent lamp when it is in its prescribed position, the shroud including a substrate and an infrared-reflective coating disposed on the substrate, and a concave reflector defining a longitudinal fixture axis;

wherein the shroud is configured to reflect a substantial portion of the infrared light emitted by the one or more filaments of the incandescent lamp back to the one or more filaments;

wherein the shroud further is configured to transmit a substantial portion of the visible light emitted by the one or more filaments of the incandescent lamp to the concave reflector, which in turn reflects such visible light to project a beam of light along the longitudinal fixture axis; and wherein the incandescent lamp comprises an envelope having a closed interior space and a longitudinal axis, wherein the one or more filaments are located in the interior space of the envelope, and forward and rearward filament supports positioned in the interior space of the envelope, with the one or more filaments disposed between them, wherein each filament support comprises a block of material extending transversely across substantially the entire interior space of the envelope and having an average total reflectance of at least 90% across a wavelength range of 500 to 2000 nanometers.

2. The incandescent illumination system as defined in claim 1, wherein:

the shroud's substrate has an inner surface and an outer surface; and the infrared-reflective coating is disposed on the inner surface of the shroud's substrate.

3. The incandescent illumination system as defined in claim 1, wherein:

the incandescent lamp further comprises an envelope having a substantially cylindrical portion surrounding its one or more filaments;

the shroud has a substantially cylindrical shape; and the envelope of the incandescent lamp and the shroud are mounted substantially concentric with the longitudinal fixture axis.

4. The incandescent illumination system as defined in claim 3, wherein:

the one or more filaments of the incandescent lamp include a plurality of linear filaments arranged around a longitudinal lamp axis; and the lighting fixture and the incandescent lamp are configured such that longitudinal lamp axis and the longitudinal fixture axis are substantially aligned with each other, being spaced apart from each other by no more than 10% of the diameter of the substantially cylindrical portion of the envelope.

5. The incandescent illumination system as defined in claim 4, wherein the lighting fixture and the incandescent lamp are configured such that longitudinal lamp axis and the longitudinal fixture axis are spaced apart from each other by no more than 4% of the diameter of the substantially cylindrical portion of the envelope.

6. The incandescent illumination system as defined in claim 3, wherein:

the one or more filaments of the incandescent lamp include a plurality of linear filaments arranged around a longitudinal lamp axis; and the lighting fixture and the incandescent lamp are configured such that longitudinal lamp axis and the longitudinal fixture axis are aligned within 0.50 millimeters of each other.

7. The incandescent illumination system as defined in claim 1, wherein:

the portion of the lamp envelope surrounding the one or more filaments and the forward and rearward filament supports has a substantially cylindrical shape; and the forward and rearward filament supports each have a substantially cylindrical side wall sized to fit snugly within the envelope.

8. The incandescent illumination system as defined in claim 1, wherein:

wherein the forward and rearward filament supports both are formed primarily of a porous ceramic material having a porosity of 10% or less;

the forward and rearward filament supports each include a face that faces the one or more filaments and reflects light received from the one or more filaments back toward the one or more filaments, the face of the other filament support, or the portion of the envelope located radially outward of the one or more filaments; and the faces of the forward and rearward filament supports both provide diffuse reflection of light received from the one or more filaments.

9. The incandescent illumination system as defined in claim 1, wherein the forward and rearward filament supports both are formed primarily of a porous ceramic material having a porosity of 10% or less.

10. The incandescent illumination system as defined in claim 9, wherein the porous ceramic material is selected from the group consisting of alumina, zirconia, magnesia, and mixtures thereof.

11. The incandescent illumination system as defined in claim 9, wherein the forward and rearward filament supports both are substantially alkali- and hydroxyl-free and have a calcia concentration of less than or equal to 20 parts per million.

12. The incandescent illumination system as defined in claim 9, wherein the forward and rearward filament supports both have a grain size distribution ranging from about 1-50 microns and an average grain size in the range of about 5-15 microns.

13. The incandescent illumination system as defined in claim 9, wherein the forward and rearward filament supports both have a pore size distribution ranging from about 0.2-20 microns and an average pore size in the range of about 2-6 microns.

14. The incandescent illumination system as defined in claim 9, wherein the forward and rearward filament supports both have a density in the range of about 92-98% of their theoretical maximum density.

15. The incandescent illumination system as defined in claim 9, wherein the forward and rearward filament supports both have a closed porosity or open porosity of less than about 1%.

16. The incandescent illumination system as defined in claim 9, wherein the forward and rearward filament supports have a closed porosity or open porosity of less than about 0.5%.

17. The incandescent illumination system as defined in claim 1, wherein:

the envelope includes forward and rearward pinched ends; and the forward filament support is located adjacent to the forward pinched end and substantially fills the interior space of the envelope between the one or more filaments and the forward pinched end; and the rearward filament support is located adjacent to the rearward pinched end and substantially fills the interior space of the envelope between the one or more filaments and the rearward pinched end.

18. The incandescent illumination system as defined in claim 1, wherein:

the envelope includes forward and rearward pinched ends;

the forward filament support is located adjacent to the forward pinched end;

the rearward filament support is located adjacent to the rearward pinched end; and the incandescent lamp further comprises a halogen-compatible filler material substantially filling the space within the envelope between the forward filament support and the forward pinched end and between the rearward filament support and the rearward pinched end.

19. The incandescent illumination system as defined in claim 1, wherein:

the one or more filaments includes only a single linear filament;

the incandescent lamp further comprises two power leads associated with the filament;

the forward filament support and the rearward filament support each include a lead aperture for slidably receiving one of the two power leads; and the locations of the lead apertures in the forward and rearward filament supports positions the filament in a prescribed position in the interior space of the envelope, with its linear axis substantially aligned with the longitudinal axis of the envelope.

20. The incandescent illumination system as defined in claim 1, wherein:

the one or more filaments include only two substantially identical linear filaments connected together in series by an intervening loop;

the incandescent lamp further includes two power leads connected to the opposite ends of the series-connected filaments and a support hook for supporting the loop connecting the two filaments;

the rearward filament support includes two lead apertures, each sized to slidably receive a separate one of the two power leads;

the forward filament support includes a support hook aperture configured to support the support hook; and the locations of the lead apertures and the support hook aperture positioning the two filaments in prescribed positions in the interior space of the envelope, with their linear axes substantially parallel to, and on opposite sides of, the longitudinal axis of the envelope.

21. The incandescent illumination system as defined in claim 1, wherein:

the one or more filaments include an odd number of three or more substantially identical linear filaments connected together in series by intervening loops;

the incandescent lamp further includes two power leads connected to the opposite ends of the series-connected filaments, and a plurality of support hooks, each supporting one of the loops connecting adjacent filaments of the three or more filaments;

the forward and rearward filament supports each include a lead aperture, each sized to slidably receive a separate one of the two power leads;

the forward and rearward filament supports together include a plurality of support hook apertures, each configured to support a separate one of the plurality of support hooks; and the locations of the lead apertures and the support hook apertures positioning the three or more filaments in prescribed positions in the interior space of the envelope, with their linear axes substantially parallel to, and spaced around, the longitudinal axis of the envelope.

22. The incandescent illumination system as defined in claim 1, wherein:

the one or more filaments include an even number of four or more substantially identical linear filaments connected together in series by intervening loops;

the incandescent lamp further includes two power leads connected to the opposite ends of the series-connected filaments, and a plurality of support hooks, supporting one of the loops connecting adjacent filaments of the four or more filaments;

the rearward filament support includes two lead apertures, each sized and configured to slidably receive a separate one of the two power leads;

the forward and rearward filament supports together further include a plurality of support hook apertures, each configured to support a separate one of the plurality of support hooks; and the locations of the lead apertures and the support hook apertures positioning the four or more filaments in prescribed positions in the interior space of the envelope, with their linear axes substantially parallel to, and spaced around, the longitudinal axis of the envelope.

23. The incandescent illumination system as defined in claim 1, wherein:

the incandescent lamp further comprises two power leads associated with the one or more filaments;

the forward filament support and/or the rearward filament support include separate lead apertures for slidably receiving the two power leads; and the location of each of the lead apertures positions one end of the adjacent filament in a prescribed position in the interior space of the envelope.

24. The incandescent illumination system as defined in claim 23, wherein each of the power lead apertures includes an enlarged portion having a transverse dimension substantially larger than that of the power lead extending through it.

25. The incandescent illumination system as defined in claim 23, and further comprising segments of tungsten wire wrapped around each of the two power leads, adjacent to the ends of the power lead apertures, for securing the associated forward or rearward filament support in its prescribed position in the interior space of the envelope.

26. The incandescent illumination system as defined in claim 25, wherein:

each of the power leads is a separate tungsten rod;

each of the power lead apertures includes an enlarged portion having a transverse dimension substantially larger than that of the power lead extending through it; and the end of the filament adjacent to each power lead is wrapped around the power lead in the enlarged end portion of the associated power lead aperture.

27. The incandescent illumination system as defined in claim 1, wherein:

the one or more filaments of the incandescent lamp extend along, or parallel with, the longitudinal axis of the envelope; and the lamp is free of any support structure located in the interior space of the envelope, radially outward of the one or more filaments.

28. The incandescent illumination system as defined in claim 1, wherein:

the one or more filaments of the incandescent lamp extend along, or parallel with, the longitudinal axis of the envelope;

the incandescent lamp further comprises one or more elongated supports extending between the forward and rearward filament supports and oriented substantially parallel with the longitudinal axis of the envelope, wherein the one or more elongated supports are substantially transparent in the wavelength range of about 500 to 2500 nanometers; and the lamp is free of any support structure located in the interior space of the envelope, radially outward of the one or more filaments, other than the one or more transparent supports.

29. The incandescent illumination system as defined in claim 1, wherein:

the one or more filaments are connected together in series and extend along, or parallel with, the longitudinal axis of the envelope;

the incandescent lamp further comprises two power leads associated with the one or more filaments;

the forward filament support and/or the rearward filament support include separate power lead apertures for slidably receiving and supporting the two power leads; and the incandescent lamp further comprises segments of tungsten wire wrapped around each of the two power leads, adjacent to the ends of the power lead apertures, for securing the associated forward or rearward filament support in its prescribed position in the interior space of the envelope.

30. The incandescent illumination system as defined in claim 1, wherein:

the one or more filaments include a single linear filament;

the incandescent lamp further comprises two power leads; and the forward and rearward filament supports each include a power lead aperture for slidably receiving and supporting one of the two power leads, the locations of the lead apertures in the forward and filament supports positioning the linear filament with its linear axis aligned with the longitudinal axis of the envelope.

31. The incandescent illumination system as defined in claim 1, wherein:

the one or more filaments of the incandescent lamp include an even number of four or more linear filaments connected together serially by loops and located in the interior space of the envelope;

the incandescent lamp further comprises two power leads and a plurality of support hooks, for supporting the loops connecting adjacent filaments of the series-connected filaments; and the rearward filament support includes separate power lead apertures for slidably receiving and supporting the two power leads;

the forward and rearward filament supports together further include support hook apertures for supporting the plurality of support hooks; and the locations of the power lead apertures and the support hook apertures position the filaments in prescribed positions in the interior space of the envelope, with their linear axes spaced around, and parallel with, the longitudinal axis of the envelope.

32. The incandescent illumination system as defined in claim 1, wherein the incandescent lamp and the shroud are separately mounted in prescribed positions relative to the concave reflector and are configured such that the incandescent lamp is removable from the lighting fixture without requiring removal of the shroud.

33. An incandescent illumination system comprising:

(a) a concave reflector;

(b) an electrical socket mounted in a prescribed position relative to the concave reflector;

(c) an incandescent lamp including (1) a base configured to releasably seat in the electrical socket and to receive electrical power therefrom, (2) one or more filaments for emitting visible light and infrared light, (3) an envelope secured to the base and defining a closed interior space and a longitudinal axis, (4) forward and rearward filament supports positioned in the interior space of the envelope, with the one or more filaments disposed between them, wherein each filament support comprises a block of material extending transversely across substantially the entire interior space of the envelope and having an average total reflectance of at least 90% across a wavelength range of 500 to 2000 nanometers; and (d) a shroud encircling the incandescent lamp and comprising (1) a transparent substrate having an inner surface facing toward the incandescent lamp and an outer surface facing away from the incandescent lamp, and (2) a coating system deposited onto the transparent substrate, wherein the coating system comprises a dielectric coating configured to transmit a substantial portion of visible light emitted by the lamp filament and to reflect a substantial portion of infrared light emitted by the lamp filament.

34. The incandescent illumination system as defined in claim 33, wherein the dielectric coating is deposited onto the inner surface of the transparent substrate using a plasma-impulse chemical vapor deposition or atomic layer deposition process.

35. The incandescent illumination system as defined in claim 33, wherein the coating system is deposited onto the inner surface of the transparent substrate and further includes:

a transparent conductive coating underlying the dielectric coating, wherein the transparent conductive coating is configured to transmit a substantial portion of visible light emitted by the lamp filament and transmitted through the dielectric coating and further is configured to reflect a substantial portion of infrared light emitted by the lamp filament and transmitted through the dielectric coating, and wherein the transparent substrate is configured to transmit a substantial portion of visible light transmitted through the transparent conductive coating;

a first diffusion barrier located between the dielectric coating and the transparent conductive coating; and a second diffusion barrier located between the transparent conductive coating and the transparent substrate.

36. The incandescent illumination system as defined in claim 35, wherein the first and second diffusion barriers comprise a material selected from the group consisting of silicon nitride, aluminum oxide, and silicon dioxide.

37. The incandescent illumination system as defined in claim 35, wherein the transparent conductive coating comprises a material selected from the group consisting of indium-doped tin oxide, aluminum-doped zinc oxide, titanium-doped indium oxide, fluorine-doped tin oxide, fluorine-doped zinc oxide, cadmium stannate, gold, silver, and mixtures thereof.

38. The incandescent illumination system as defined in claim 33, wherein:

the lamp envelope comprises fused silica glass; and the shroud substrate comprises alumino-silicate glass.

39. The incandescent illumination system as defined in claim 33, wherein:

the dielectric coating comprises a plurality of dielectric layers having prescribed refractive indices and prescribed thicknesses;

the plurality of dielectric layers comprise alternating layers of a first material having a relatively low refractive index and of a second material having a relatively high refractive index; and the transparent substrate and the second material of the dielectric coating have coefficients of thermal expansion that differ from each other by no more than a factor of 2.5.

40. The incandescent illumination system as defined in claim 39, wherein:

the second material is selected from the group consisting of niobia, titania, tantala, and mixtures thereof; and the transparent substrate comprises alumino-silicate glass.

41. The incandescent illumination system as defined in claim 33, wherein the incandescent lamp and the shroud are separately mounted in prescribed positions relative to the concave reflector and are configured such that the incandescent lamp is removable from the electrical socket without requiring removal of the shroud.

42. An incandescent illumination system comprising:

(a) a concave reflector;

(b) an electrical socket mounted in a prescribed position relative to the concave reflector;

(c) an incandescent lamp including (1) a base configured to releasably seat in the electrical socket and to receive electrical power therefrom, (2) one or more filaments for emitting visible light and infrared light, and (3) an envelope secured to the base and defining a closed interior space and a longitudinal axis, (4) forward and rearward filament supports positioned in the interior space of the envelope, with the one or more filaments disposed between them, wherein each filament support comprises a block of material extending transversely across substantially the entire interior space of the envelope and having an average total reflectance of at least 90% across a wavelength range of 500 to 2000 nanometers; and (d) a shroud encircling the incandescent lamp and comprising (1) a transparent substrate having an inner surface facing the lamp and an outer surface facing away from the lamp, and (2) a coating system deposited onto the transparent substrate, the coating system including a dielectric coating configured to transmit a substantial portion of visible light emitted by the lamp filament and to reflect a substantial portion of infrared light emitted by the lamp filament, wherein the dielectric coating comprises a plurality of alternating layers of a first material having a relatively low refractive index and of a second material having a relatively high refractive index, (3) wherein the transparent substrate and the second material of the dielectric coating have coefficients of thermal expansion that differ from each other by no more than a factor of 2.5.

43. The incandescent illumination system as defined in claim 42, wherein:

the coating system is deposited onto the inner surface of the transparent substrate and further comprises a transparent conductive coating underlying the dielectric coating; and the transparent conductive coating is configured to transmit a substantial portion of visible light emitted by the lamp filament and transmitted through the dielectric coating, and further configured to reflect a substantial portion of infrared light emitted by the lamp filament and transmitted through the dielectric coating.

44. The incandescent illumination system as defined in claim 42, wherein the incandescent lamp and the shroud are separately mounted in prescribed positions relative to the concave reflector and are configured such that the incandescent lamp is removable from the electrical socket without requiring removal of the shroud.

45. A lighting fixture for use in combination with an incandescent lamp to project a beam of light, the lighting fixture comprising:

a concave reflector defining a longitudinal fixture axis;

a socket mounted on the concave reflector and configured to removably hold an incandescent lamp; and a shroud mounted in a prescribed position relative to the concave reflector and the socket and configured to surround at least a portion of an incandescent lamp held by the socket, the shroud including a transparent substrate and an infrared-reflective coating system disposed thereon;

wherein the shroud's infrared coating system is configured to reflect a substantial portion of infrared light emitted from an incandescent lamp held by the socket back to the incandescent lamp for absorption by a lamp filament;

wherein the shroud further is configured to transmit a substantial portion of visible light emitted from an incandescent lamp held by the socket to the concave reflector, which in turn reflects such visible light to project a beam of light along the longitudinal fixture axis; and wherein the lighting fixture is configured such that an incandescent lamp held by the socket is removable from the lighting fixture without requiring removal of the shroud.

46. The lighting fixture as defined in claim 45, wherein:

the shroud's transparent substrate has an inner surface and an outer surface; and the infrared-reflective coating system is deposited onto the substrate's inner surface using a plasma.

47. The lighting fixture as defined in claim 45, wherein:

the socket defines a longitudinal lamp axis substantially aligned with the longitudinal fixture axis of the concave reflector; and the shroud's transparent substrate has a substantially cylindrical shape oriented substantially concentric with the longitudinal fixture axis.

48. The lighting fixture as defined in claim 45, wherein the infrared-reflective coating system includes a dielectric coating deposited onto the inner surface of the transparent substrate using a plasma-impulse chemical vapor deposition or atomic layer deposition process.

49. The lighting fixture as defined in claim 45, wherein:

the infrared-reflective coating system comprises a dielectric coating that includes a plurality of dielectric layers having prescribed refractive indices and prescribed thicknesses;

the plurality of dielectric layers comprise alternating layers of a first material having a relatively low refractive index and of a second material having a relatively high refractive index; and the transparent substrate and the second material of the dielectric coating have coefficients of thermal expansion that differ from each other by no more than a factor of 2.5.

50. The lighting fixture as defined in claim 49, wherein:

the second material is selected from the group consisting of niobia, titania, tantala, and mixtures thereof; and the transparent substrate comprises alumino-silicate glass.

51. The lighting fixture as defined in claim 45, wherein the shroud is configured such that an incandescent lamp is removable from the electrical socket without requiring removal of the shroud.

52. The lighting fixture as defined in claim 45, wherein the infrared-reflective coating system is deposited onto the inner surface of the transparent substrate and includes:

a dielectric coating;

a transparent conductive coating underlying the dielectric coating, wherein the transparent conductive coating is configured to transmit a substantial portion of visible light emitted by the lamp filament and transmitted through the dielectric coating and further is configured to reflect a substantial portion of infrared light emitted by the lamp filament and transmitted through the dielectric coating, and wherein the transparent substrate is configured to transmit a substantial portion of visible light transmitted through the transparent conductive coating;

a first diffusion barrier located between the dielectric coating and the transparent conductive coating; and a second diffusion barrier located between the transparent conductive coating and the transparent substrate.

* * * * *